US012635787B2

(12) United States Patent
Speicher et al.

(10) Patent No.: US 12,635,787 B2
(45) Date of Patent: May 26, 2026

(54) ORAL CARE IMPLEMENT WITH FLUID DISPENSING SYSTEM

(71) Applicant: Colgate-Palmolive Company, New York, NY (US)

(72) Inventors: Erin Speicher, Hoboken, NJ (US); Leighton Davies-Smith, Lebanon, NJ (US); Adam P. Vallee, Cato, NY (US); Mark Bartlett, North East, PA (US)

(73) Assignee: Colgate-Palmolive Company, New York, NY (US)

( * ) Notice: Subject to any disclaimer, the term of this patent is extended or adjusted under 35 U.S.C. 154(b) by 239 days.

(21) Appl. No.: 18/253,089

(22) PCT Filed: Nov. 1, 2021

(86) PCT No.: PCT/US2021/057533
§ 371 (c)(1),
(2) Date: May 16, 2023

(87) PCT Pub. No.: WO2022/108742
PCT Pub. Date: May 27, 2022

(65) Prior Publication Data

US 2024/0000222 A1 Jan. 4, 2024

Related U.S. Application Data

(60) Provisional application No. 63/114,908, filed on Nov. 17, 2020.

(51) Int. Cl.
*A46B 11/00* (2006.01)
*A46B 9/04* (2006.01)

(52) U.S. Cl.
CPC ..... *A46B 11/0006* (2013.01); *A46B 9/04* (2013.01); *A46B 11/001* (2013.01)

(58) Field of Classification Search
CPC ..... A46B 9/04; A46B 9/06
See application file for complete search history.

(56) References Cited

U.S. PATENT DOCUMENTS 4,826,341 A 5/1989 Kwak
5,033,898 A 7/1991 Williams
(Continued)

FOREIGN PATENT DOCUMENTS

EP 1544584 6/2005
KR 200438811 Y1 * 3/2008 ..... A46B 9/04
WO 2022/108742 5/2022

OTHER PUBLICATIONS

Machine Translation of KR 20-0438811 (Seo) (Year: 2008).*
(Continued)

*Primary Examiner* — David P Angwin
*Assistant Examiner* — Bradley S Oliver

(57) ABSTRACT

An oral care implement with fluid dispensing system includes a head, handle, and intermediate neck. The head comprises plural tooth cleaning elements. A reservoir containing oral care fluid is fluidly coupled to an elastomeric valve nested between a pair of longitudinally spaced protective lamellas on the head. A depressible actuator button operates to dispense the oral care fluid from the reservoir through the valve to the tooth cleaning elements. The protective lamellas formed of elastomeric material are foldable to alternating cover the valve to prevent ingress of external fluids in the oral cavity of the user into the valve to minimize fouling of the fluid dispensing system. Laterally open areas between the lamella allow the oral care fluid to migrate outwards to the tooth cleaning elements. To control the dosage of oral care fluid dispensed, a modular system comprising interchangeable spacer inserts is usable to change and customize the dosage.

17 Claims, 21 Drawing Sheets

(56) References Cited

U.S. PATENT DOCUMENTS

| | | | | |
|---|---|---|---|---|
| 5,297,882 | A | 3/1994 | Kornides | |
| 5,411,176 | A | 5/1995 | Favre | |
| 5,908,257 | A | 6/1999 | Martin | |
| 6,257,791 | B1 | 7/2001 | Scamard | |
| 6,406,207 | B1 | 6/2002 | Wiegner et al. | |
| 6,669,930 | B1 | 12/2003 | Hoic et al. | |
| 6,770,266 | B2 | 8/2004 | Santarpia, III et al. | |
| 6,808,331 | B2 | 10/2004 | Hall et al. | |
| 7,237,974 | B2 | 7/2007 | Pfenniger et al. | |
| 7,722,278 | B2 | 5/2010 | Black | |
| 7,789,583 | B2 | 9/2010 | Kuo | |
| 7,975,343 | B2 * | 7/2011 | Hohlbein | A46B 15/0032 15/167.1 |
| 8,398,325 | B2 | 3/2013 | Wu et al. | |
| 8,444,416 | B2 | 5/2013 | Chenvainu et al. | |
| 8,458,841 | B2 | 6/2013 | Haas et al. | |
| 8,511,323 | B2 | 8/2013 | Jimenez et al. | |
| 8,517,728 | B2 | 8/2013 | Gatzemeyer et al. | |
| 8,647,007 | B2 | 2/2014 | Kuo | |
| 8,732,889 | B2 | 5/2014 | Jimenez et al. | |
| 8,747,005 | B2 | 6/2014 | Kemp et al. | |
| 8,851,331 | B2 | 10/2014 | Pelkey et al. | |
| 8,863,345 | B2 * | 10/2014 | Jimenez | A46B 9/06 15/167.1 |
| 8,919,613 | B2 | 12/2014 | Mileti | |
| 9,022,992 | B2 | 5/2015 | Helmer et al. | |
| 9,144,298 | B2 * | 9/2015 | Fattori | B05B 11/1069 |
| 9,648,943 | B2 | 5/2017 | Jimenez et al. | |
| 9,839,283 | B2 | 12/2017 | Tatu et al. | |
| 10,449,022 | B2 * | 10/2019 | Okai | A46B 9/04 |
| 2005/0272001 | A1 | 12/2005 | Blain et al. | |
| 2008/0205970 | A1 | 8/2008 | LaFlamme et al. | |
| 2010/0218378 | A1 | 9/2010 | Chenvainu et al. | |
| 2011/0182448 | A1 | 7/2011 | Lee et al. | |
| 2011/0308030 | A1 | 12/2011 | Jimenez et al. | |
| 2020/0037744 | A1 | 2/2020 | Jimenez et al. | |

OTHER PUBLICATIONS

International Search Report and the Written Opinion of the International Searching Authority issued in International Application PCT/US2021/057533 mailed Feb. 21, 2022.

* cited by examiner

ORAL CARE IMPLEMENT WITH FLUID DISPENSING SYSTEM

CROSS-REFERENCE TO RELATED APPLICATIONS

The present application is a national stage entry under 35 U.S.C. § 371 of PCT/US2021/057533, filed Nov. 1, 2021, which claims the benefit of priority to U.S. Provisional Patent Application Ser. No. 63/114,908, filed Nov. 17, 2020, the entireties of which are incorporated herein by reference.

BACKGROUND

Oral care implements, such as toothbrushes as one example, are typically used by applying dentifrice (toothpaste) to tooth cleaning elements on the head of the brush followed by brushing regions of the oral cavity, e.g., the teeth, tongue, and/or gums. Some toothbrushes have been equipped with fluid reservoirs and sub-systems for dispensing auxiliary oral care fluids such as liquids containing active agents. Examples are whitening agents, breath-freshening agents, anti-bacterial agents, and others which are applied during the tooth brushing regimen.

A number of liquid-dispensing oral care implements such as toothbrushes on the market suffer from unreliable dispensing mechanisms that usually cease functioning over repeated use due to drying, clogging, and/or jamming of the internal dispensing components after exposure to external fluids (water, toothpaste slurry, saliva, etc.) which eventually penetrate the internal dispensing sub-system of the device after just a few uses in the mouth. Therefore, there is a need for an improved oral care implement designed to prevent external fluid ingress through the toothbrush head and dispensing liquid outlet during expected use for liquid-dispensing toothbrushes.

BRIEF SUMMARY

To meet the foregoing need, an oral care implement with fluid dispensing system is disclosed which includes an elastomeric valve having an elastic memory which resiliently biases the valve towards the closed position. The valve may be a duckbill valve in one non-limiting embodiment changeable between the biased normally closed position and an open position for dispensing the oral care fluid. The oral care implement may be a toothbrush having a head fitted with tooth cleaning elements including an array of bristles and elastomeric lamella in one implementation. The valve, nested within the tooth cleaning elements, is fluidly coupled to an onboard reservoir containing the oral care fluid. The reservoir may be defined by a user-replaceable cartridge detachably coupled to the handle of the toothbrush. The oral care fluid may be any flowable oral care substance including without limitation liquids or flowable semi-solid materials (e.g. pastes) in some embodiments having a viscosity which enables the substance to flow at room temperature under applied positive or negative pressure.

In one embodiment, the duckbill valve associated with the fluid dispensing system may be positioned between a protective pair of resiliently deformable elastomeric lamellas. The protective lamellas may be longitudinally spaced apart and are alternatingly foldable during brushing motions to at least partially cover and enclose the duckbill valve. This advantageously minimizes or prevents external fluids within the field of tooth cleaning elements on the toothbrush head (e.g. toothpaste slurry, saliva, water, etc.) from entering the valve which can cause clogs or fouling of the fluid dispensing system over time resulting in fluid dispensing malfunctions which were noted above. Laterally open areas provided between the protective lamellas on the sides of the duckbill valve allow the oral care fluid to easily enter lateral bristle tufts on the toothbrush head and disperse to more uniformly to quickly distribute the fluid to the tooth cleaning element array.

Fluid dispensing is activated via an actuator on the toothbrush handle which is operably coupled to the fluid dispensing system. The actuator may be an elastomeric diaphragm button which is manually depressible to create a pumping action to dispense the oral care fluid from the fluid reservoir. A modular pumping mechanism comprising interchangeable spacer inserts located beneath the button allow the volume of oral care fluid dispensed with each pumping stroke (i.e. dosage) to be changed to suit the various types of oral care agents in the fluid which might be used.

In one aspect, a toothbrush with oral care fluid dispenser comprises: an elongated body defining a longitudinal axis, a head defining a distal end, a handle defining a proximal end, and neck extending between the head and handle; the head comprising an array of tooth cleaning elements; a reservoir configured for storing an oral care fluid; an actuator operable to dispense the oral care fluid from the reservoir; an elastomeric valve nested between a spaced apart pair of a first protective lamella and second protective lamella, the valve fluidly coupled to the reservoir; and wherein the valve is resiliently changeable between a normally closed position and an open position for dispensing the oral care fluid from the reservoir when the actuator is actuated.

In another aspect, a method for brushing teeth using a toothbrush comprising an oral care fluid dispensing system comprises: providing the toothbrush defining a longitudinal axis, a handle comprising a reservoir containing an oral care fluid, and a head comprising an array of tooth cleaning elements and an elastomeric valve nested between an elastomeric first protective lamella and an elastomeric second protective lamella, the valve fluidly coupled to the reservoir; depressing an actuator operably coupled to the reservoir and valve; discharging an amount of the oral care fluid from the valve; moving the toothbrush in a brushing stroke in a first longitudinal direction while engaging the teeth; and the teeth resiliently bending the first protective lamella to engage the second protective lamella which at least partially covers the valve to deter ingress of external fluids into the valve.

In another aspect, an oral care implement with a modular fluid dispensing mechanism comprises: an elongated body defining a longitudinal axis and a handle having a proximal end and a distal end; a reservoir disposed in the handle and containing an oral care fluid; a valve fluidly coupled to the reservoir via a flow conduit; a movable actuator button operable to dispense the oral care fluid from the reservoir through the valve via a manual pumping stroke; the actuator button enclosing an outwardly open pump cavity fluidly coupled to the flow conduit; a plurality of interchangeable spacer inserts each having a common mounting interface configured for insertion into the pump cavity of the handle, a trapped volume being formed between the actuator button and an inserted one of the spacer inserts which corresponds to a dosage of oral care fluid dispensed with each pumping stroke of the actuator button; the spacer inserts including a first spacer insert having a first configuration; the spacer inserts further including a second spacer insert having a second configuration different than the first configuration; wherein the dosage of oral care fluid dispensed with each pumping stroke is changeable via mounting the first spacer insert or second spacer insert in the pump cavity.

In another aspect, a method for forming a fluid-dispensing oral care implement with a preselected oral care fluid dosage comprises: selecting a spacer insert from a plurality of prefabricated spacer inserts each having different configuration; inserting the selected spacer insert into an injection mold in an actuator button seating area of an oral care implement portion of the injection mold; and molding an oral care implement body onto the selected spacer insert.

In another aspect, a method for forming an oral care implement with modular fluid dispensing mechanism comprises: providing an elongated body defining a longitudinal axis and a handle having a proximal end and a distal end, a reservoir disposed in the handle and containing an oral care fluid, a valve fluidly coupled to the reservoir via a flow conduit, and a movable actuator button operable to dispense the oral care fluid from the reservoir through the valve via a manual pumping stroke, wherein the actuator button encloses an outwardly open pump cavity fluidly coupled to the flow conduit; providing a plurality of interchangeable spacer inserts each having a common mounting interface configured for insertion into the pump cavity of the handle, the spacer inserts including a first spacer insert having a first configuration and a second spacer insert having a second configuration different than the first configuration; inserting one of the first or second spacer inserts into the pump cavity; forming a trapped volume between the actuator button and the inserted one of the first or second spacer inserts which corresponds to a dosage of oral care fluid dispensed with each pumping stroke of the actuator button; wherein the dosage of oral care fluid dispensed with each pumping stroke is changeable via mounting the first spacer insert or second spacer insert in the pump cavity.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The features, and advantages of the invention will be apparent from the following more detailed description of certain embodiments of the invention and as illustrated in the accompanying drawings in which.

Figure 1:
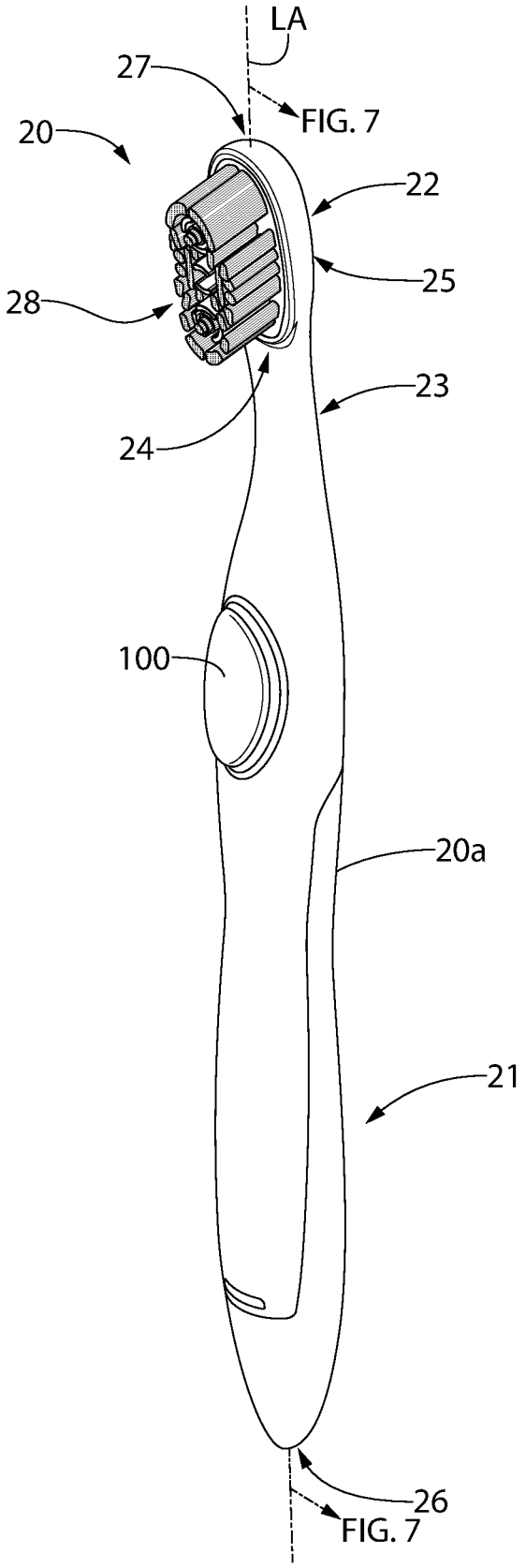
FIG. 1 is a front perspective view of an oral care implement in the form of a toothbrush having a fluid dispensing system according to the present disclosure.
Figure 2:
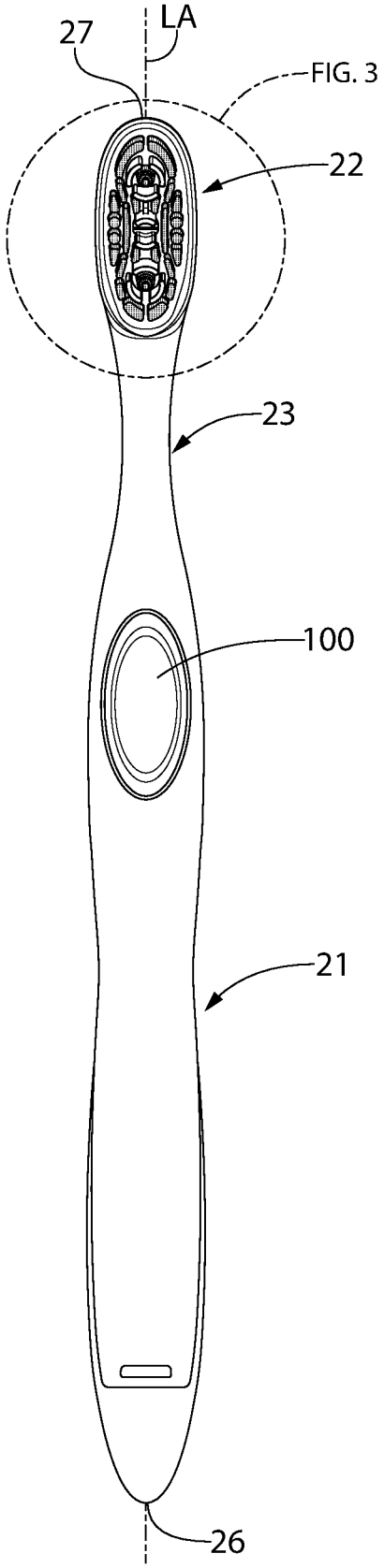
FIG. 2 is a front view thereof.

All drawings are considered schematic and not necessarily to scale; Features appearing numbered in some figures which appear in other figures not numbered are the same features unless expressly noted otherwise herein.

DETAILED DESCRIPTION

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Figure 21A:
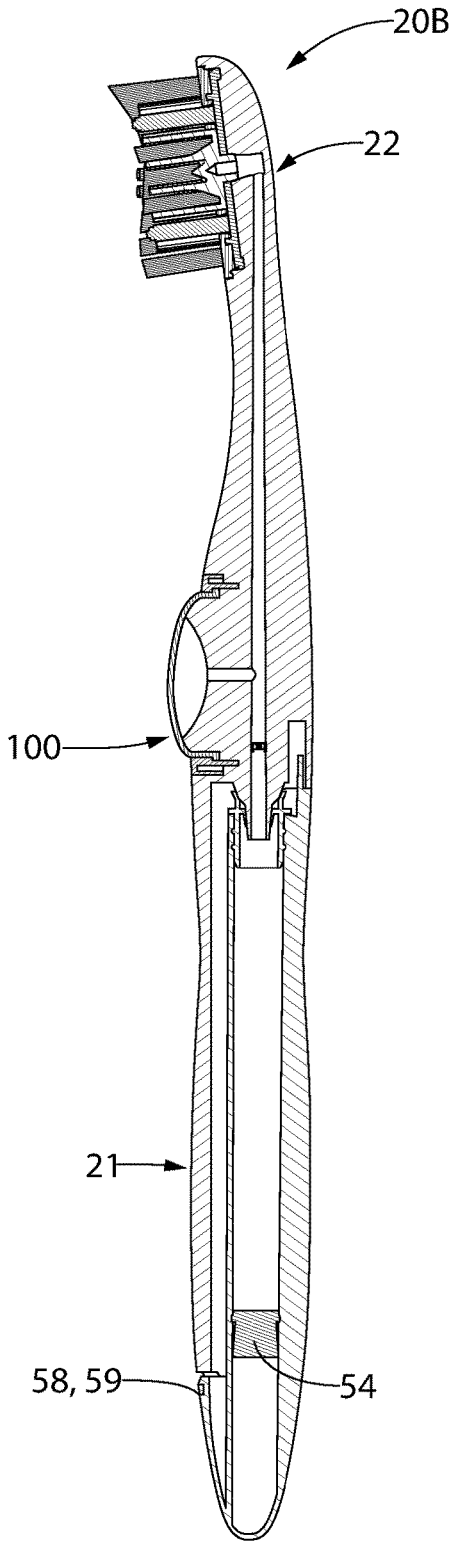
FIG. 21A is a longitudinal cross sectional view of the toothbrush showing a fourth spacer insert installed in pumping mechanism of the toothbrush.
Figure 21B:
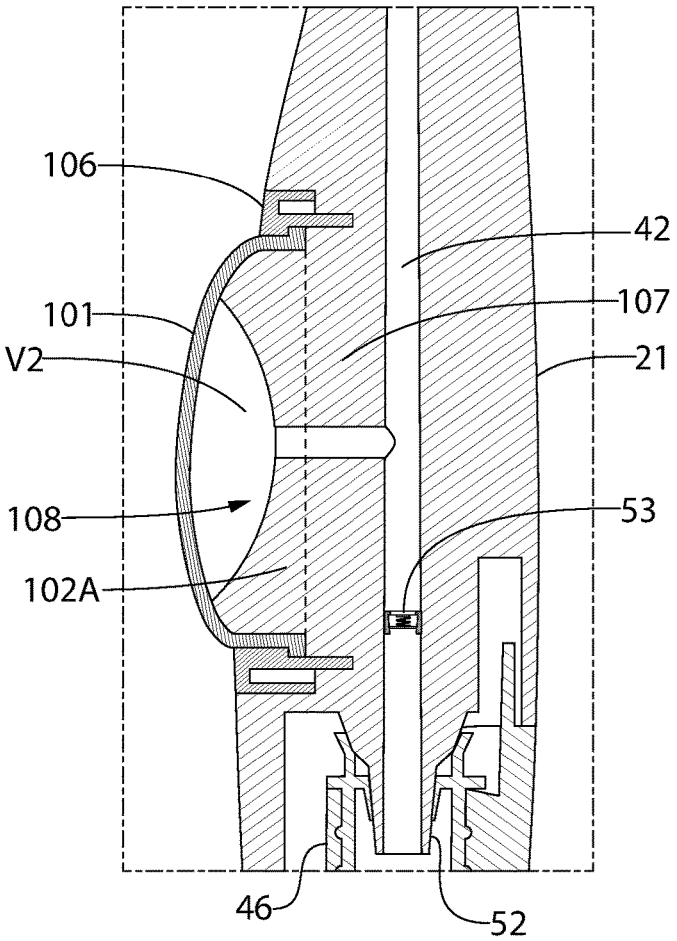
FIG. 21B is an enlarged view taken from FIG. 21A.

FIGS. 1-10 show one non-limiting embodiment of an oral care implement which may be a fluid-dispensing toothbrush 20 containing an oral care fluid 32 (shown in FIGS. 21A-C). Toothbrush 20 has an axially elongated body 20*a* defining a longitudinal axis LA. The toothbrush includes a handle 21 defining a proximal end 26 of the toothbrush and a head 22 defining an opposite distal end 27 of the toothbrush. The head 22 is supported by the handle via an intermediate neck 23 extending between the head and handle in one configuration. The head, handle, and neck may be different integral parts of a monolithic unitary body in one non-limiting embodiment, or may be separate parts coupled together in other possible constructions. The body of the toothbrush 20 may having any suitable configuration including straight sections and/or curved sections with varying diameters or width and is expressly not limited to the simple example illustrated in FIG. 1 for convenience.

The longitudinal axis LA follows the contours and shapes of the toothbrush body 101 from proximal to distal ends 26, 27 and remains at the centerline of each transverse section of the body through which the longitudinal axis extends. Accordingly, the longitudinal axis LA is not necessarily a straight reference line in all cases depending on the shape and curvature of the toothbrush body, and the view of the user when looking at the toothbrush from different angles and orientations.

In certain embodiments, neck 23 may a dimensionally narrower structure in width and/or height (measured transversely to longitudinal axis LA) than the head 22 and/or handle 21. The configuration of the neck is not limiting of the invention and may have any suitable configuration.

In the exemplified embodiment, the elongated body of toothbrush 20 may be made of any suitable orally hygienic suitable material such as without limitation a rigid plastic material. Some non-limiting example materials include polymers and copolymers of ethylene, propylene, butadiene, vinyl compounds and polyesters such as polyethylene or polyethylene terephthalate. Of course, the invention is not to be so limited in all embodiments and the body or certain portions thereof (handle, neck, and/or head) may be formed with a semi-rigid material. Handle 21 may further include surface portions which are formed of a non-slip resilient material for greater comfort and handling, such as without limitation thermoplastic elastomer (TPE) affixed such as via overmolding to select portions or the entirety of the handle to enhance gripping the toothbrush during use. For example, parts of the handle 21 that are typically gripped by a user's palm, fingers, and/or thumb during use may be partially or totally overmolded with a thermoplastic elastomer or other resilient material to further increase comfort and grip for a user, as well as change the aesthetics. The body of toothbrush 20 may be formed by injection molding, extrusion, and/or other processes and combinations of processes. The materials of construction for the toothbrush, and fabrication methods used is not limiting of the invention.

Head 22 includes a front side 24, opposing rear side 25, and pair of opposing lateral sides 64 which extend longitudinally. The front side 24 of the head 22 may be substantially planar in one embodiment. The head 22 comprises a plurality of tooth cleaning elements 28 extending transversely from the front side such as perpendicularly and/or obliquely thereto. The exact types, structure, pattern, orientation, and material of the array of tooth cleaning elements on head 22 is not limiting of the present invention unless so specified in the claims.

As used herein, the term "tooth cleaning elements" is used in a generic sense to refer to any structure or combination of structures that can be used to clean, polish or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, spiral bristles, rubber bristles, elastomeric protrusions such as lamellas, and combinations thereof and/or other structures formed of such materials. Suitable elastomeric materials include any biocompatible resilient material suitable for uses in an oral hygiene apparatus. To provide optimum comfort as well as cleaning benefits, the elastomeric material of the tooth cleaning lamella may have a hardness property in the range of A8 to A25 Shore hardness. One suitable elastomeric material is thermoplastic elastomer (TPE) such as without limitation styrene-ethylene/butylene ne-styrene block copolymer (SEBS) manufactured by GLS Corporation. Nevertheless, SEBS material from other manufacturers or other materials within and outside the noted hardness range could be used.

The tooth cleaning elements 28 of the present invention can be permanently attached to the head 22 in any suitable manner and is not limiting of the invention exempt to the extent which may be recited in the claims. For example, staples/anchors, in-mold tufting (IMT), or anchor free tufting (AFT) could be used to mount the cleaning elements/tooth engaging elements. In AFT, a membrane or "head plate" 30 is secured to the brush head such as by ultrasonic welding. The bristles extend through the plate. The free ends of the bristles on one side of the outward facing exposed side of the plate perform the tooth cleaning function. The ends of the bristles on the other concealed side of the plate received in a recessed well 31 of the head are melted together by heat and anchored in place. Any suitable form of cleaning elements may be used in the broad practice of this invention.

Figure 3:
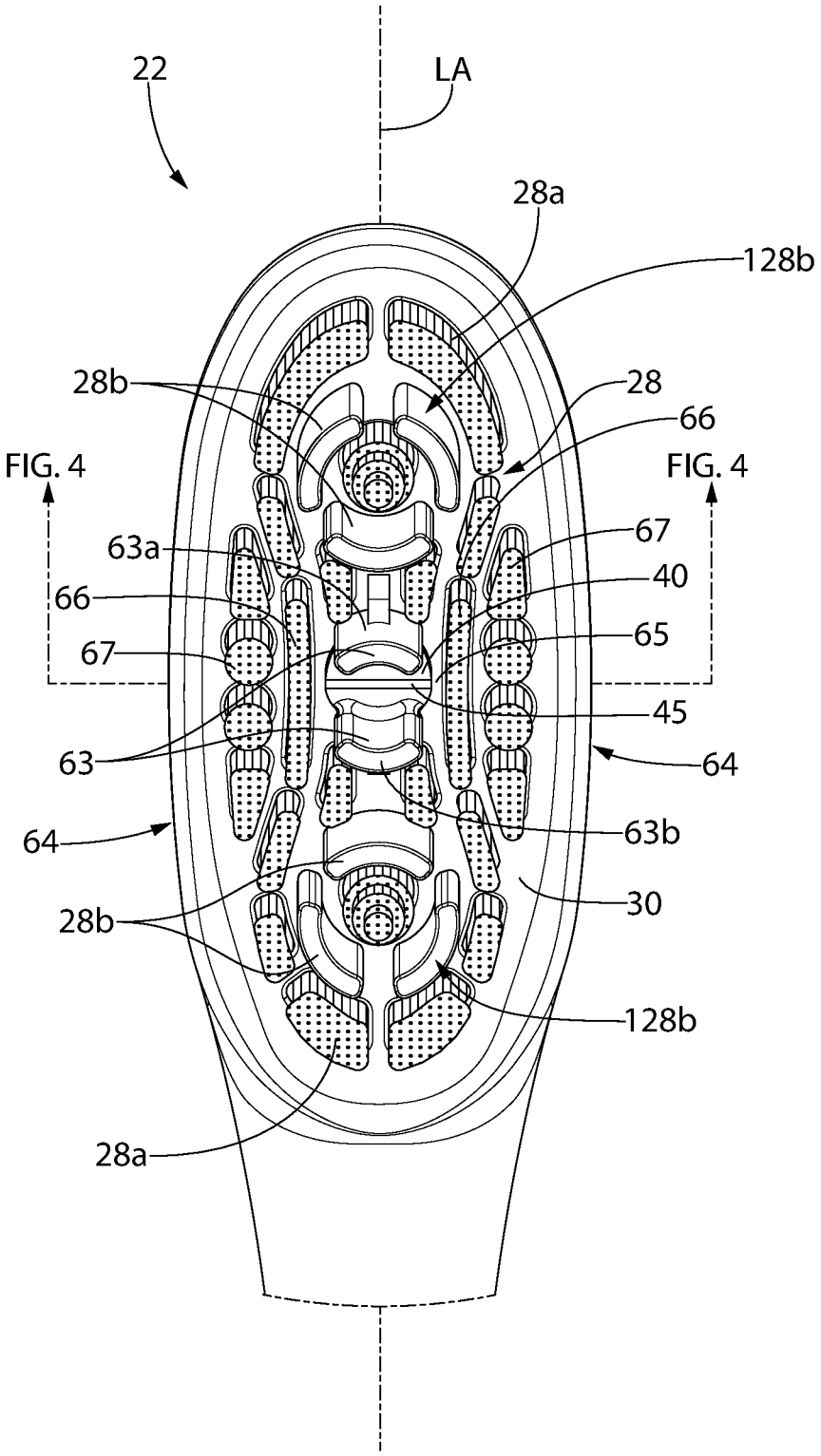
FIG. 3 is an enlarged front view of the head of the toothbrush taken from FIG. 2.
Figure 4:
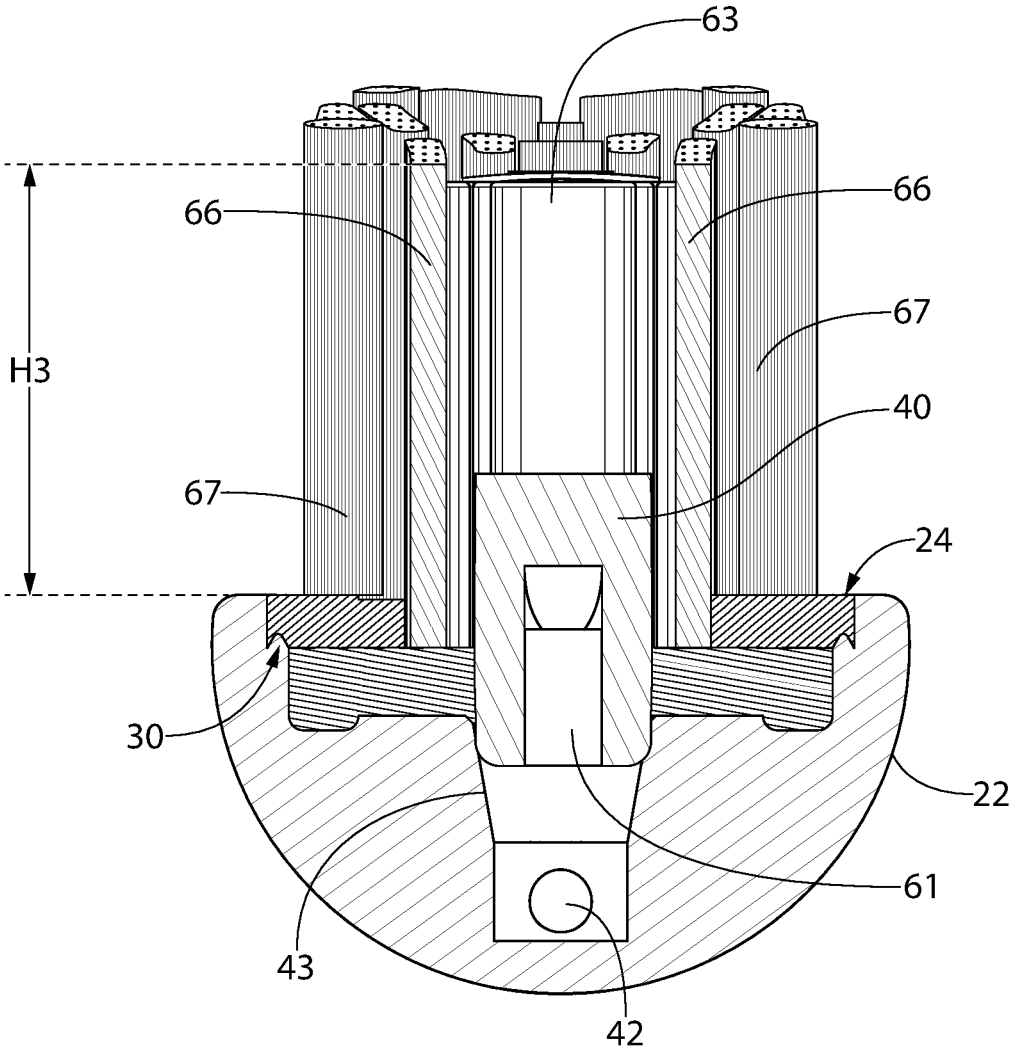
FIG. 4 is a transverse cross-sectional view of the head taken from FIG. 3.

In the non-limiting illustrated embodiment, the tooth cleaning elements 28 include an array of bristles 28*a* and elastomeric lamellas 28*b*. In one embodiment, a distal and proximal lamella cluster 128*b* may be provided; each comprising a trio of lamellas 28*b* arranged in a circumferentially spaced apart pattern as best shown in FIG. 3. Other elastomeric lamellas and/or bristles may be arranged in further clusters or tufts of various configurations; some of which are further described herein.

The fluid dispensing system according to the present disclosure generally includes a fluid dispensing valve such as elastomeric duckbill valve 40 in one embodiment, an internal oral care fluid reservoir 41, and a longitudinally-extending internal flow conduit 42 extending through the toothbrush body 20*a* which fluidly couples the reservoir to the valve. Flow conduit 42 may have a circular cross section shape in some embodiments; however, other suitable cross-sectional polygonal and non-polygonal shapes may be used. The flow conduit may be integrally formed as an opening molded through the body of the toothbrush (i.e. head, neck, and handle) when formed, or may be a separate tubular member inserted through the body. Either construction may be used.

Figure 5:
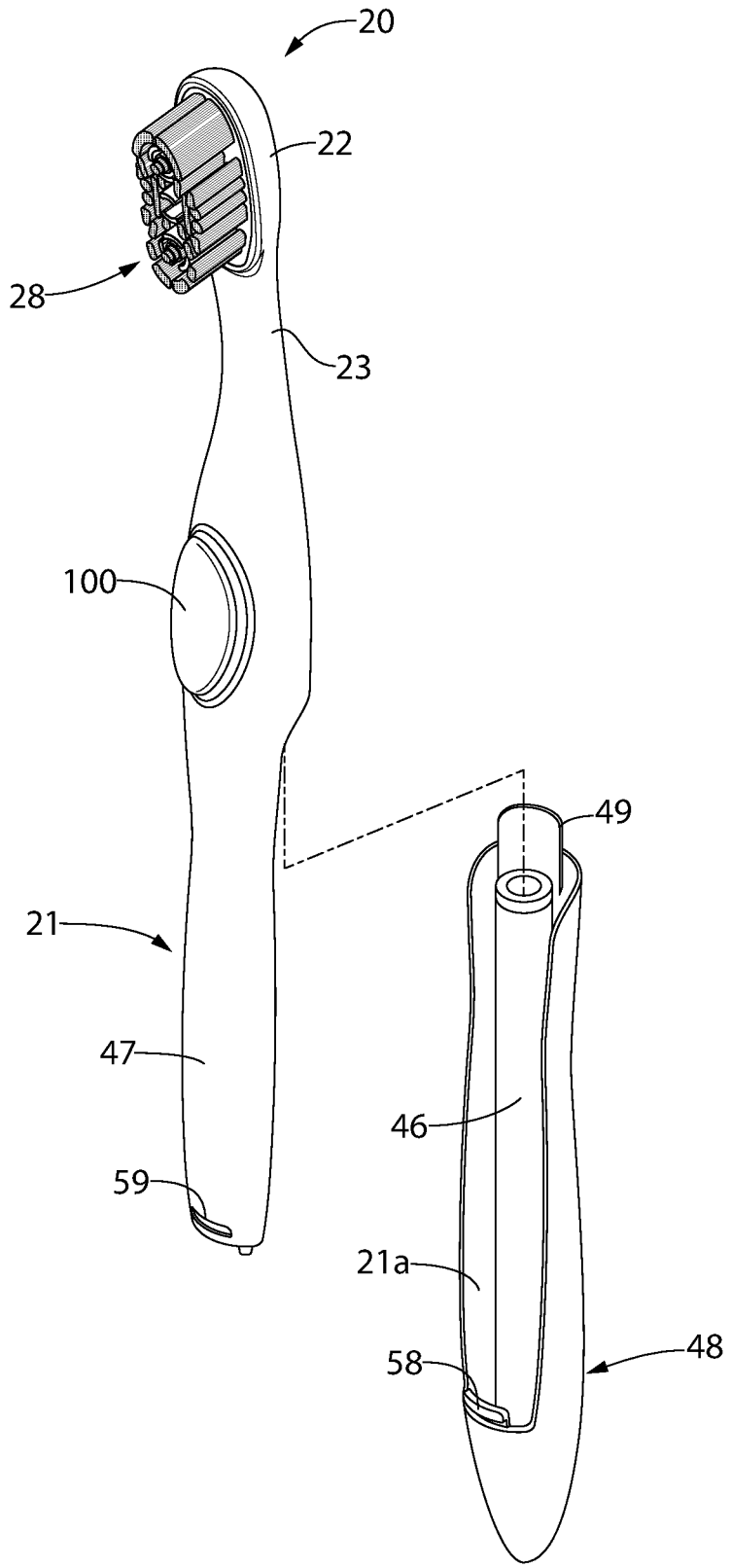
FIG. 5 is an exploded front perspective view of the toothbrush of FIG. 1.
Figure 6:
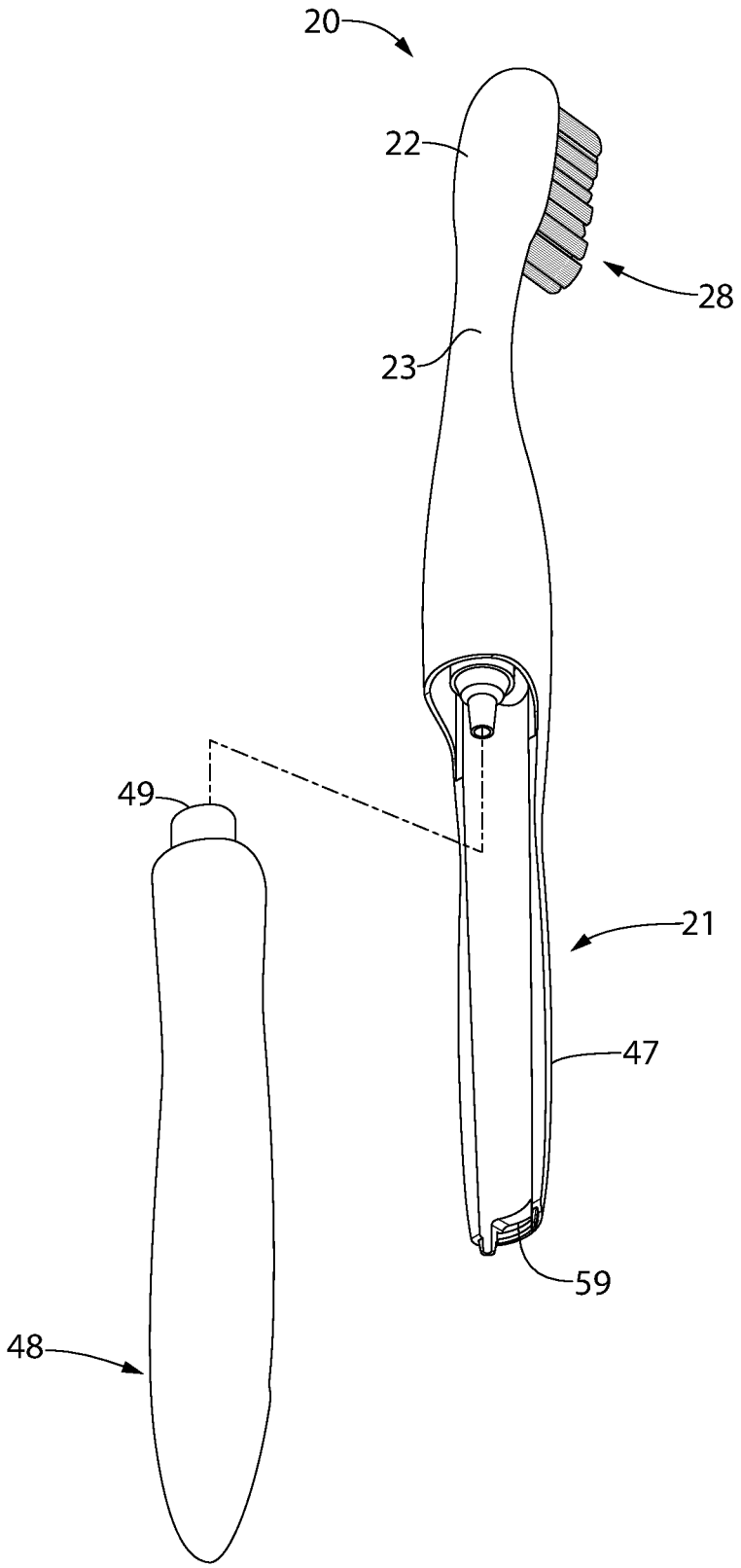
FIG. 6 is an exploded rear perspective view of the toothbrush.
Figure 7:
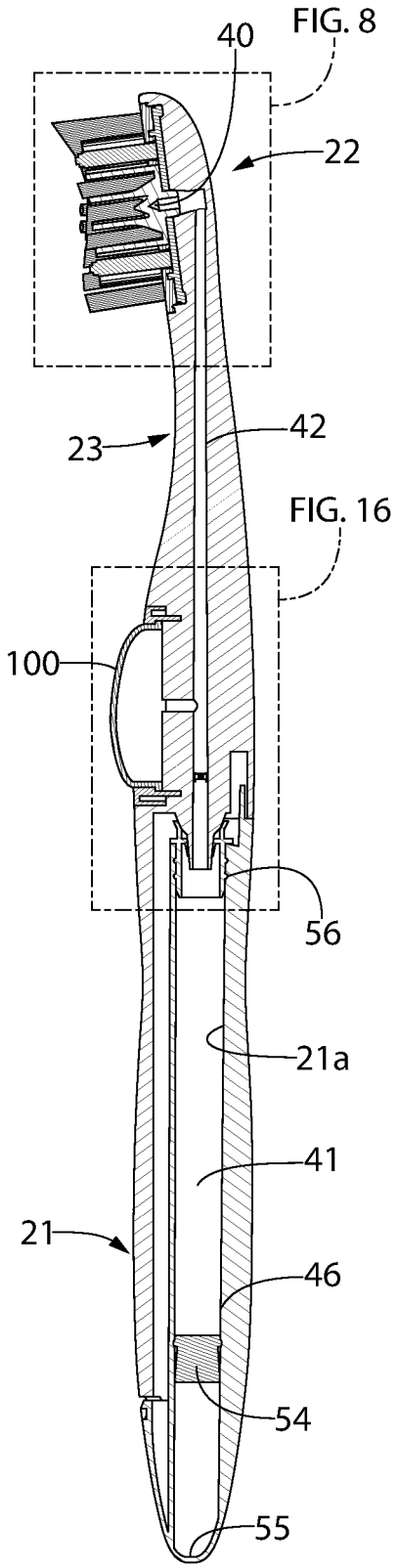
FIG. 7 is a longitudinal cross-sectional view of the toothbrush taken from FIG. 1.
Figure 16:
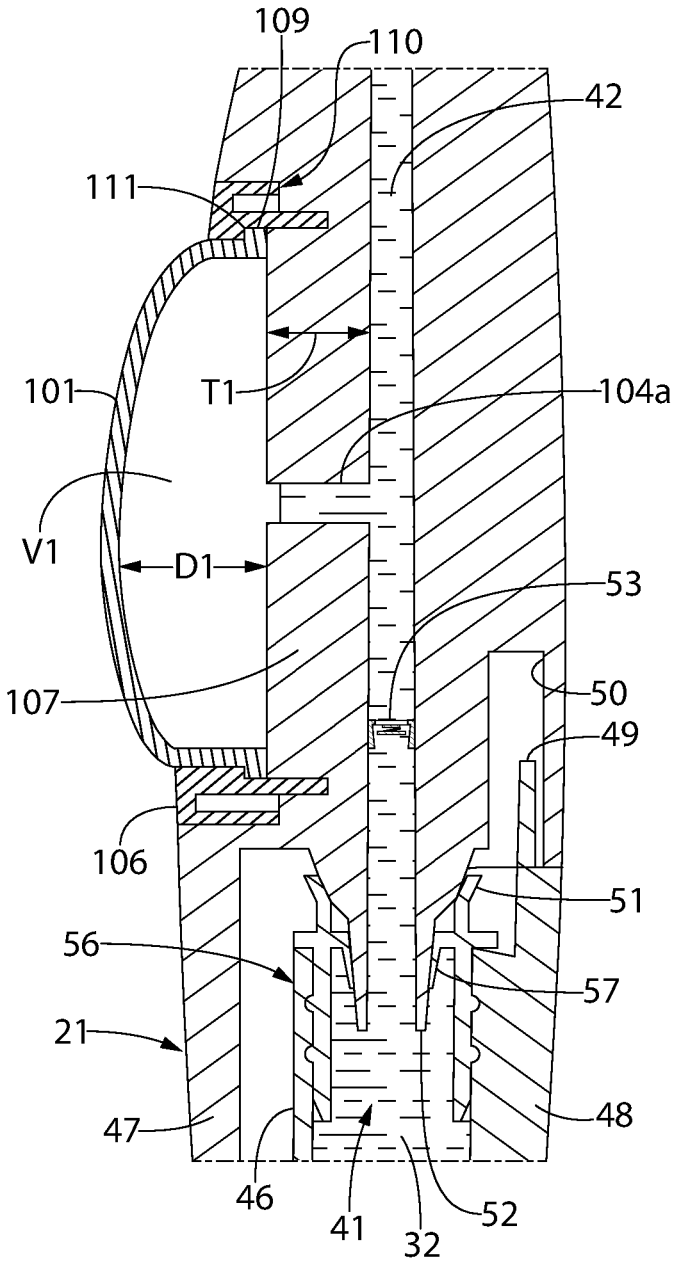
FIG. 16 is an enlarged longitudinal cross sectional view of the pumping mechanism of the toothbrush without additional of spacer inserts.

In one embodiment, the oral care fluid reservoir 41 may be defined by a fluid cartridge 46 removably disposed and inserted in an internal longitudinal cavity 21*a* of the handle 21. In one construction as shown in FIGS. 5 and 6, handle 21 may have a fixed front portion 47 which is integrally formed with the toothbrush body as a unitary structural part thereof; and a detachable rear portion 48 which defines longitudinal cavity 21*a*. Rear portion 48 receives cartridge 46 in the cavity. In some embodiments, the cartridge 26 may be integrally formed as a unitary structural part of the rear portion 48. Cartridge 46 has a hollow cylindrical tubular body for storing the oral care fluid 32 therein (see, e.g. FIGS. 21A-C). With additional reference to FIGS. 16A and 16B, cartridge 46 further includes a proximal end 55 and a distal end 56 which is terminated with an outwardly flared mouth 51 of frustoconical shape. Mouth 51 receives inwardly tapered inlet nozzle 52 which is integrally formed with the distal portion of handle 21 along with the neck 23 and head 22 of the toothbrush body. Nozzle 52 is an integral part of the proximal end of the flow conduit 42 which extends through the nozzle. A fluid seal is formed between the nozzle 52 and distal end 56 of cartridge 46 via a frictional fit between the tapered nozzle and mouth 51. The outwardly flared mouth 51 helps guide the narrowed nozzle 52 into the cartridge, which enhances the frictional fit therebetween to complete the fluid coupling. Cartridge 46 may be equipped with a frangible seal 57 which preserves the integrity contents of the cartridge (i.e. oral care agent) until attached to toothbrush 20. Seal 57 covers the cartridge mouth and is punctured by insertion of the flow conduit inlet nozzle 52 into the mouth of the cartridge. FIG. 16 shows the frangible seal in the post-mounted punctured and torn condition.

To help properly locate and attached the rear portion 48 of handle 21 to front portion 47, some embodiments of the rear portion may include a longitudinally-extending locating tab 49 which is received in a rear pocket 50 of the proximal handle portion (reference FIGS. 5-6 and 16A-B). Locating tab protrudes distally and longitudinally from detachable handle rear portion 48 and the pocket 50 is open towards the proximal direction to insertably receive the tab therein when the detachable rear portion is assembled to the front portion 47 of the handle 21. The rear portion 48 may be locked to the front portion 47 via a locking tab 58 received through an open locking slot 59 formed in the front portion of the handle 21. Locking slot 59 may be located at the proximal end of the handle front portion and the locking tab 58 may be spaced inward from the proximal end of the rear portion 48 which in some embodiments as shown may include and define the proximal end 26 of the toothbrush body.

Oral care fluid cartridge 46 may include a longitudinally movable piston follower 54 which closes and seals the proximal end of the cartridge. As oral care fluid is depleted each time the fluid is dispensed, the piston follower 54 advances in the distal direction towards the head to preclude formation of a vacuum within the reservoir 41 of the cartridge by equalizing pressure in the fluid dispensing system. Follower 54 may be made of rubber or an elastomeric polymer in some embodiments as non-limiting examples which are capable of forming a movable fluid seal at the distal end of the cartridge 46.

Figure 8:
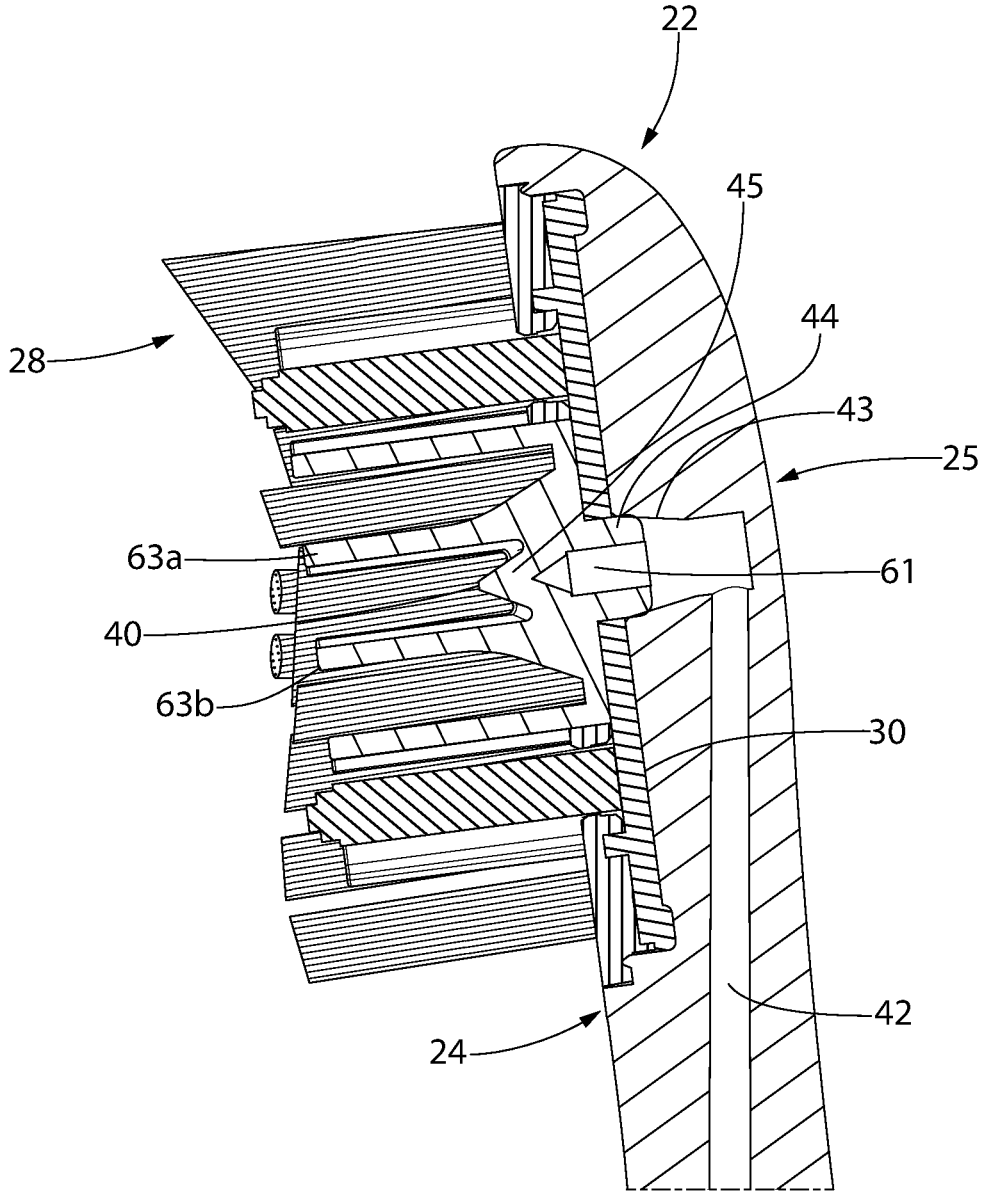
FIG. 8 is an enlarged view taken from FIG. 7.
Figure 9:
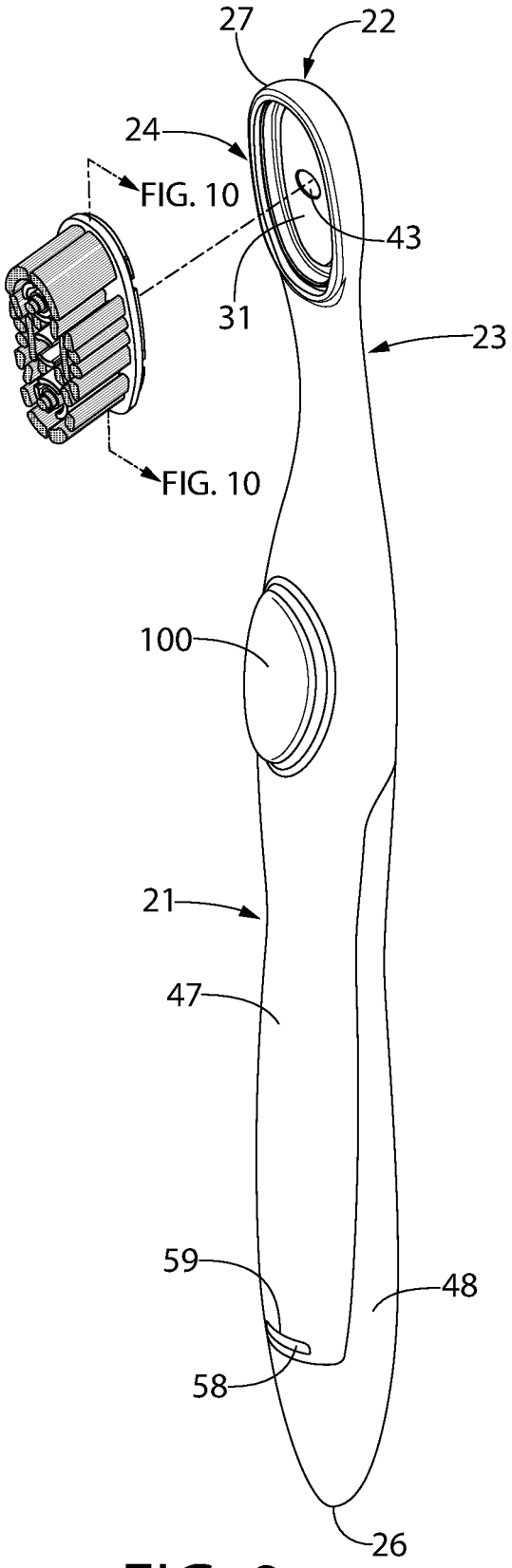
FIG. 9 is a front exploded view of the head of the toothbrush.
Figure 13:
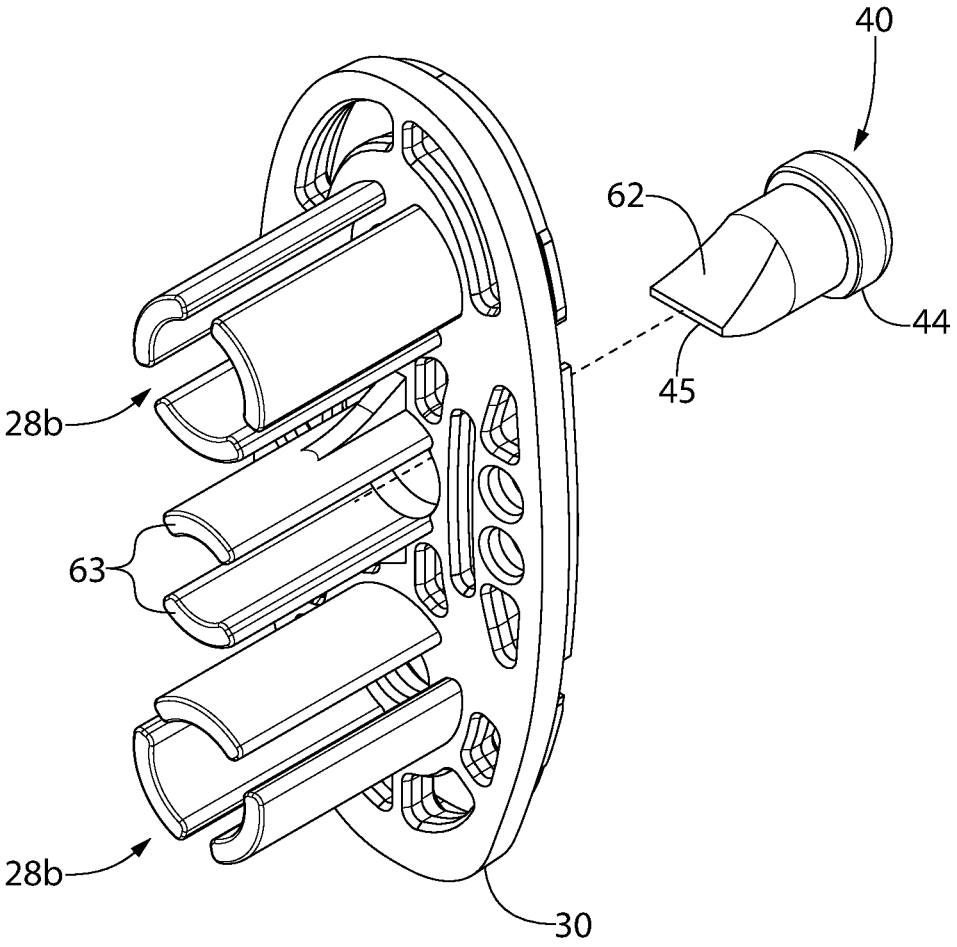
FIG. 13 is a perspective view of an alternative construction of the fluid dispensing valve and protective lamella.

Referring to FIGS. 8 and 13, the distal end of flow conduit 42 is terminated with an open outlet socket or port 43. An inlet plug 44 of duckbill valve 40 is insertably received in the outlet port 43 and forms a fluid coupling therewith. A frictional fit between the flexible elastomeric plug 44 (formed integrally with the valve body) and the mounting through hole 60 in head plate 30 retains the valve to the plate and outlet portion 43 of the fluid dispensing system. Internal flow passage 61 extends through plug 44 to outlet slit 45 which is resiliently biased normally closed by the elastic memory of the valve, and openable under pressurized flow to dispense oral care fluid 32 to the field of tooth cleaning elements when the fluid is pressurized by actuator 100, as further described herein. Removing pressure recloses the valve and stops the flow of oral care fluid dispensed to the tooth cleaning elements 28. The body of duckbill valve 40 may be considered generally cylindrical in some embodiments with exception of the chisel shaped flaps 62 which converge to form the linear outlet slit 45.

The duckbill valve 40 and operably cooperating tooth cleaning elements 28 on head 22 which functionally interact in the dispensing of oral care fluid to minimize or prevent external fluids in the oral cavity (i.e. mouth) from entering the valve and fouling the fluid dispensing system during brushing will now be described.

Referring initially to FIGS. 3, 8, and 10-13, duckbill valve 40 may be centrally located on toothbrush head 22 within the array of tooth cleaning elements 28 and approximately in the geometric center of the head in some non-limiting as illustrated. The openable/closeable flaps 62 of the valve which defines linear outlet slit 45 protrude from head plate 30 perpendicularly to longitudinal axis LA of the toothbrush 20.

Although a duckbill valve is illustrated and described herein, other types of resiliently-biased elastomeric valves and differing configurations may be used. Other types of outlet slits may be used including without limitation cross-shaped slits. Accordingly, the disclosure is not limited to the use of a duckbill valves alone in the fluid dispensing system.

In one embodiment, a pair of elastomeric protective lamella 63 may be disposed immediately adjacent to duckbill valve 40. In certain embodiments, there may be no bristle tufts 28*a* or other tooth cleaning elements disposed between the valve 40 and protective lamella 63 which might interfere with proper bending/folding of the lamella over the duckbill valve, as further described herein. The protective lamella may have an arcuate transverse cross-sectional shape in one embodiment; however, in other possible embodiments the protective lamella may be linearly straight in cross-sectional shape. The arcuate protective lamella each define a concave recess which may face towards the duckbill valve. The lamella will there experience less resistance to bending in the longitudinal direction towards the duckbill valve due to the structure of the arcuately shaped wall of the lamella.

Protective lamella 63 each have greater lateral width extending between the lateral sides 64 of toothbrush head 22 than longitudinal thickness such that the protective lamella are oriented in the lateral direction transversely to longitudinal axis LA. This orientation allows the protective lamella 63 to deform and bend more readily in the longitudinal direction to at least partially cover or overlay the duckbill valve 40 to minimize and deter ingress of external fluids in the oral cavity into the valve. The outlet slit 45 of duckbill valve 40 may also be oriented from side to side transversely to longitudinal axis LA in certain embodiments (e.g. perpendicularly thereto in the non-limiting illustrated embodiment). The pair of protective lamella 63 may include a distal protective lamella 63*a* disposed on a distal side of duckbill valve 40, and a proximal protective lamella 63*b* disposed on the proximal side of the valve.

Since the protective lamella 63 directly associated with duckbill valve 40 are solid elastomeric structures (e.g. TPE), a laterally open flow area 65 is provided on each side of the duckbill valve between the protective lamella. This allows the oral care fluid to more readily migrate laterally outwards from the pocket formed by the protective lamella to enter the tooth cleaning elements on the lateral sides of the valve, thereby promoting more uniform and rapid distribution of the fluid on head 22 during the initial brushing cycle. This also avoids trapping the oral care fluid in the vicinity of valve 40 on the brush head which may result in residue build-up over time on the brush head that can harbor bacteria deleterious to oral health.

Protective lamella 63 may each be supported by a stiffening rib 70. An integrally molded angled stiffening rib is integrally formed in one embodiment on sides of the protective lamella opposite the side facing the duckbill valve 40 which is a unitary structural part of the lamella. Ribs 70 may therefore be formed of the same elastomeric material as the lamella 63. The ribs 70 may have a height substantially coextensive with the height H1 of the duckbill valve as shown (or slightly higher). The outermost ends of the ribs 70 (i.e. farthest from the front surface 24 of head 22) define a bend line BL about which the protective lamella 63 will bend and fold when deformed by brushing action. Portions of the lamella below the bend line BL are more resistant to bending since they are supported by the stiffening rib. The ribs 70 may have a triangular configuration in one embodiment; however, other shapes may be used. The stiffening rib on the distal protective lamella 63*a* is arranged on a distal side thereof to resist bending towards the distal end of the head, and the stiffening rib on the proximal protective lamella 63*b* is arranged on a proximal side thereof to resist bending towards the proximal end of the head. The sides of the protective lamella facing the duckbill valve 40 are free of stiffening ribs 70 to allow the lamella to readily deform and fold over top of the valve to at least partially enclose the outlet slit of the valve.

Figure 10:
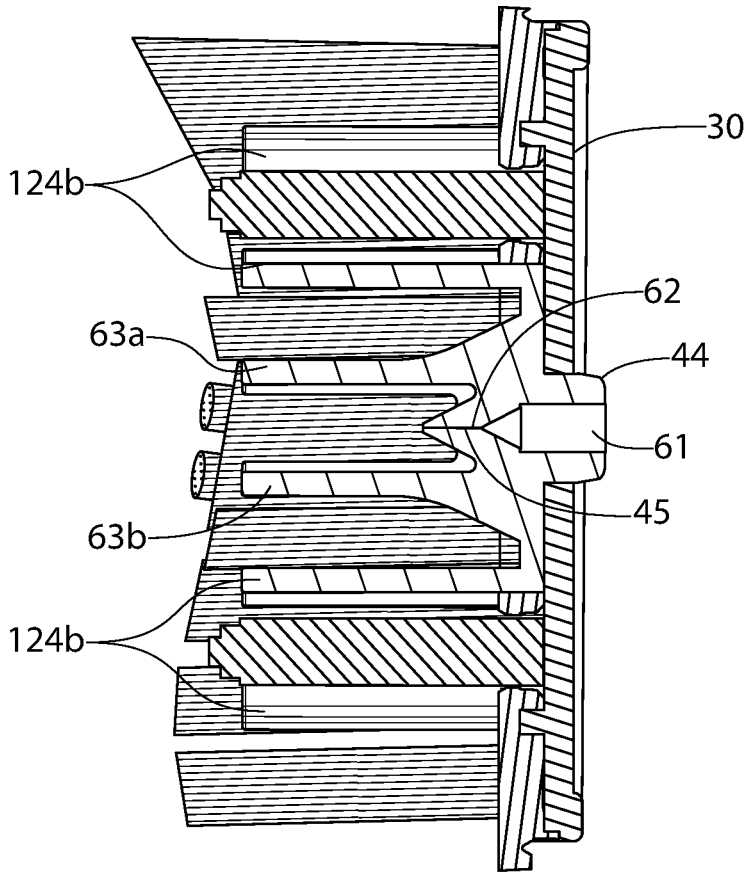
FIG. 10 is a longitudinal cross sectional view of the head of the toothbrush.
Figure 11:
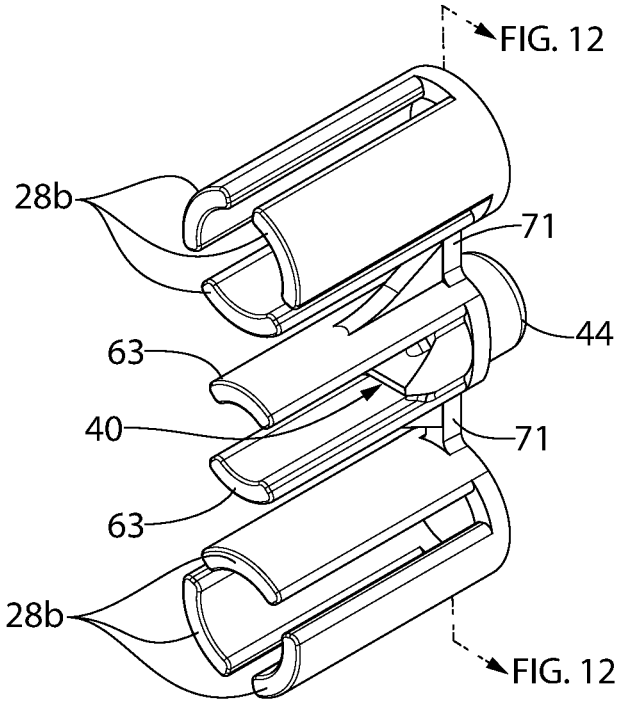
FIG. 11 is a front perspective view of one embodiment of a fluid dispensing valve and associated protective lamella of the toothbrush.
Figure 12:
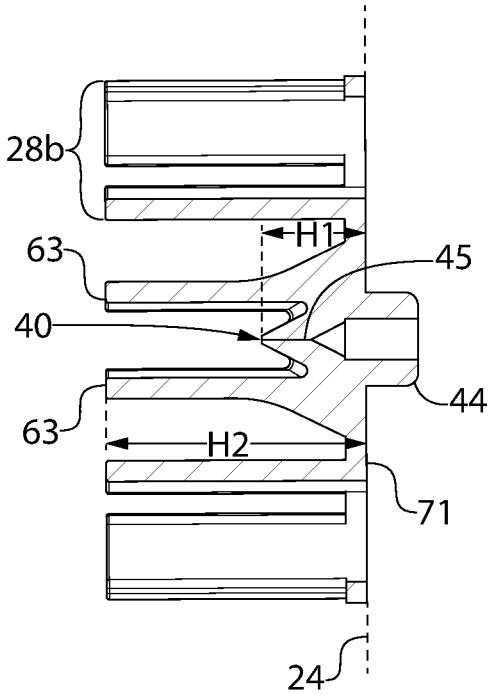
FIG. 12 is a side longitudinal cross sectional view thereof taken from FIG. 11.

The distal and proximal protective lamella 63*a*, 63*b* may have a height H2 substantially greater than the height H1 of the duckbill valve 40 measured outwards from the front face or side 24 of head 22 perpendicularly to longitudinal axis LA (reference FIGS. 8, 10, and 12). In one embodiment, height H2 of protective lamellas 63*a*, 63*b* is at least twice height H1. This height differential and proximity of the protective lamella immediately adjacent to duckbill valve 40 advantageously allow the lamella to bend and fold over to at least partially enclose the outlet slit of the valve to minimize the ingress of external fluids while brushing. This is shown in FIGS. 14A-C.

Figure 14A:
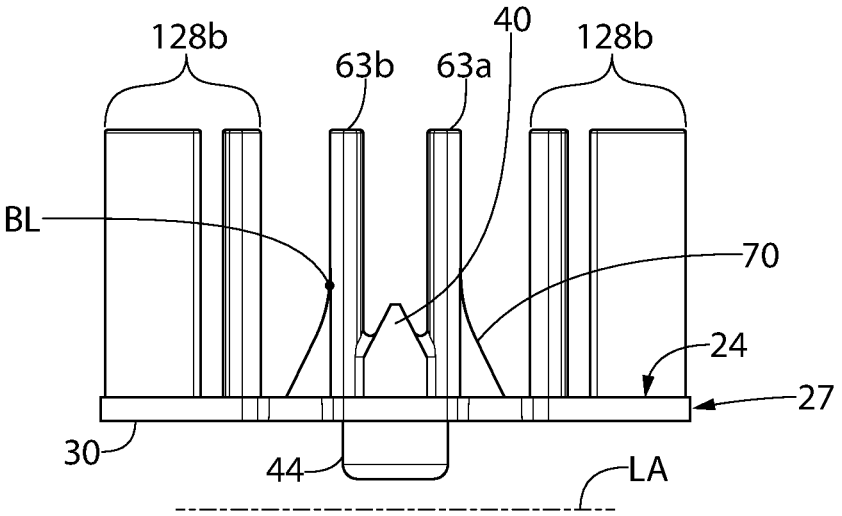
FIG. 14A is a first side view showing the fluid dispensing valve and protective lamella in an undeformed condition prior to brushing.
Figure 14B:
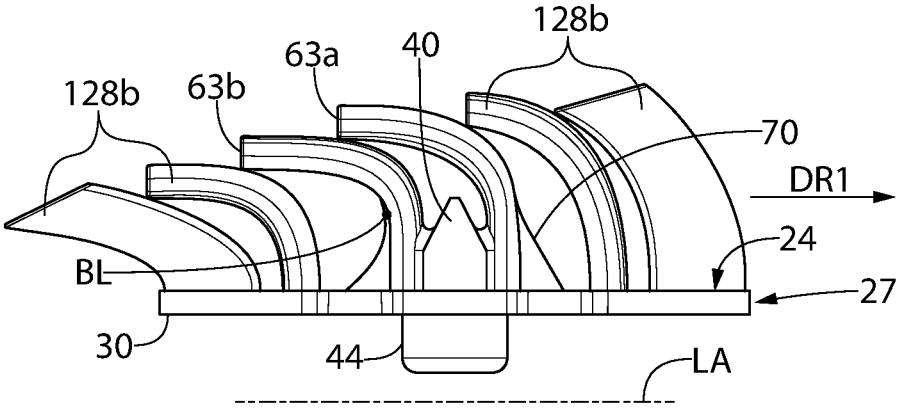
FIG. 14B is a second view thereof showing the deformation of the protective lamella during a brushing stroke in a first longitudinal direction.
Figure 14C:
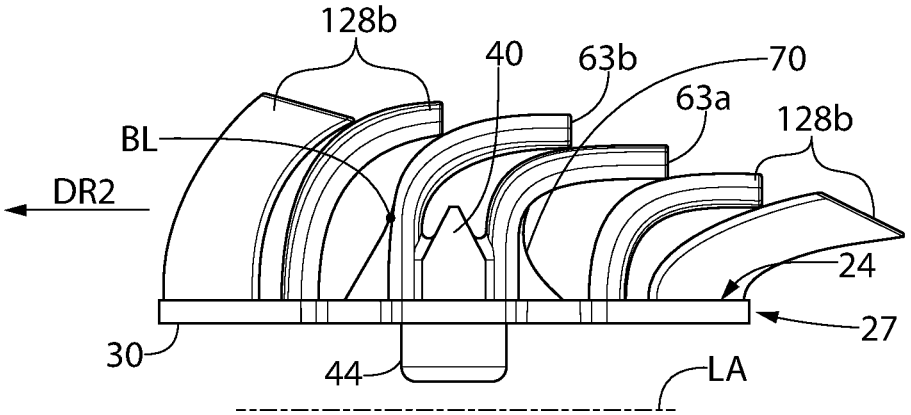
FIG. 14C is a third view thereof showing the deformation of the protective lamella during a brushing stroke in a second longitudinal direction.

FIG. 14A shows the protective lamella 63 in their upright undeformed condition/position oriented perpendicularly to longitudinal axis LA and front surface 24 of the head 22. FIG. 14B shows a brushing motion or stroke in a first longitudinal direction DR1 across the teeth. Engagement by the teeth causes the distal protective lamella 63*a* to bend and fold over top of the duckbill valve 40 to engage the proximal protective lamella 63*b*, thereby at least partially enclosing and covering the duckbill valve to block the ingress of external fluids in the mouth (i.e. oral cavity) into the duckbill valve. During a brushing stroke in an opposite second longitudinal direction DR2 shown in FIG. 14C, the proximal protective lamella 63*b* folds over to engage the distal protective lamella 63*a* and encloses/covers the duckbill valve to block ingress of external fluids into the duckbill valve. The protective lamella oscillate back and forth between these two brushing positions in FIGS. 14B and 14C while brushing the teeth. The protective lamella 63 may each also alternatingly engage the distal and proximal lamella clusters 128*b* on the toothbrush head 22 during the motions in FIGS. 14B and 14C as shown in some embodiments. In one embodiment, the duckbill valve 40, protective lamella 63, and lamella clusters 128*b* may all be aligned on the longitudinal axis LA of the toothbrush head in one arrangement as shown.

It bears noting that the protective lamella 63 are intended to preclude substantial amounts of external fluids in the mouth (e.g. dentifrice, saliva, etc.) from entering the duckbill valve 40 but may not necessarily prevent all external fluids from entering the valve. Some minimal leakage of external mouth fluids into the valve may occur through the lateral sides of the duckbill valve or past the protective lamella which may be unavoidable in some instances. Minor ingress of such leakage will it to be flushed outwards during the next fluid dispensing cycle.

To minimize the amount of external fluid in the field of tooth cleaning elements 28 from reaching and potentially entering slit 45 of the duckbill valve 40 from the side tooth cleaning elements of head 22 in the lateral direction, however, a pair of laterally opposed protective bristle tuft walls 66 may be provided immediately adjacent to the valve as best shown in FIG. 3. Bristle tuft walls 66 flank opposite lateral sides of the duckbill valve and confront each laterally open area 65 within the array of tooth cleaning elements surrounding of the valve. Tuft walls 66 may have a linear configuration in one embodiment and lie between the lateral sides 64 of toothbrush head 22 and the duckbill valve 40 as shown. The bristle tuft walls 66 may extend for a longitudinal length greater than the diameter or longitudinal length of the duckbill valve. The tuft walls may have a height H3 at least equal to the pair of protective lamellas 63 measured perpendicularly outwards from the planar front surface of the head (see, e.g. FIGS. 4 and 14A). Because the tuft walls can be penetrated by the oral care fluid during brushing motions which tend to separate the individual bristles when pressed against the teeth, the fluid can be uniformly dispersed and distributed laterally and then longitudinally among the tooth cleaning elements 28 during the brushing stroke. At the same time, the tuft walls 66 advantageously deter the inflow of external fluids in the mouth towards the duckbill valve. In some embodiments, additional lateral tooth cleaning elements such as bristle tufts 67 of various configurations (e.g. round, oblong, etc.) can be provided between lateral sides 64 of the toothbrush head 22 and the linear bristle tuft walls 66 (see, e.g. FIG. 3).

Several construction options may be used for the formation of the duckbill valve 40 and associated protective lamella 63. In one construction shown in FIGS. 11 and 12, the valve 40 and lamella 63 may be formed as a single monolithic unitary structure which is injection molded during the same process since the valve and lamella may be formed from the same elastomeric material (e.g. TPE). The elastomeric stiffening ribs 70 may also be integrally formed as part of this single molded piece. The proximal and distal lamella clusters 28*b* may also optionally be formed as integral parts of the same single structure as shown. All these features may be structurally linked together by a common longitudinally-extending spine 71 integrally formed as part of the unitary molded assemblage of parts. The molded assemblage may then be attached to the AFT head plate 30. In other possible configurations, the stiffening ribs 70 and duckbill valve may be molded as a monolithic unitary part which is separately attached to the spine 71 and protective lamella 63 unitary body.

In another construction option shown in FIG. 13, the duckbill valve 40 may be a separate discrete component which is attached to head plate 30 separately from the protective lamella 63 which may be molded as a single monolithic unitary structure. In this embodiment, the inlet plug 44 of the valve may be larger than mounting through hole 60 in head plate 30. The plug 44 is positioned beneath the head plate in front recess 31 of toothbrush head 22 when the cylindrical exposed outward portion of the valve is inserted through the plate. The plug 44 of valve 40 is still insertable received in the outlet portion 43 of the fluid dispensing system in head 22.

Modular Fluid Dispensing Mechanism

According to another aspect of the disclosure, a modular fluid dispensing mechanism for altering the amount or dosage of oral care fluid dispensed with each press of the fluid dispensing actuator 100 will now be described.

An oral care implement with fluid dispensing system according to the present disclosure comprises a manual fluid pump engine or mechanism that powers the oral care fluid delivery function. The oral care implement may be a toothbrush 20 in one embodiment, The fluid pump mechanism allows the user to press a compressible actuator 100 comprising resiliently deformable elastomeric actuator button 101 having an elastic memory which returns the button to its initial and normal undeformed condition or state when released. The button 101 is depressed to force the oral care fluid contained in reservoir 41 of user-replaceable cartridge 46 previously described herein through the length of the toothbrush interior in flow conduit 42 and dispense a volume or dosage of the fluid to the toothbrush head tooth cleaning elements.

Figure 17A:
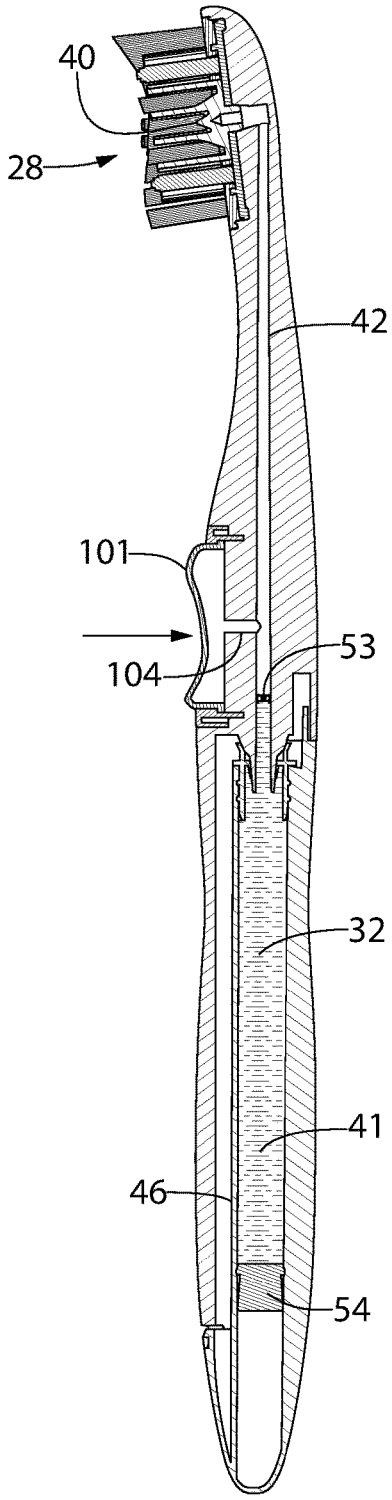
FIG. 17A is a first longitudinal cross-sectional view showing the pumping mechanism in a first priming operating position.
Figure 17B:
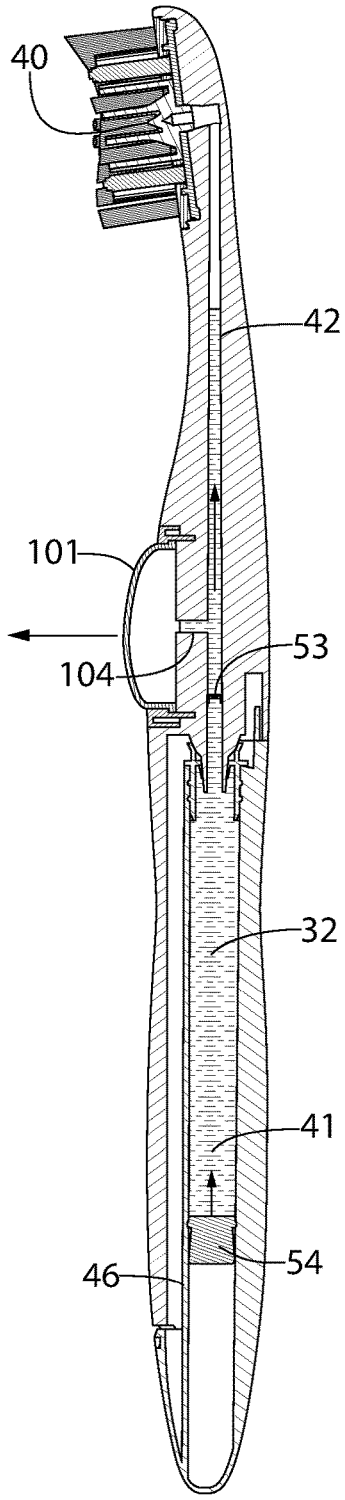
FIG. 17B is a second longitudinal cross-sectional view showing the pumping mechanism in a second priming operating position.
Figure 17C:
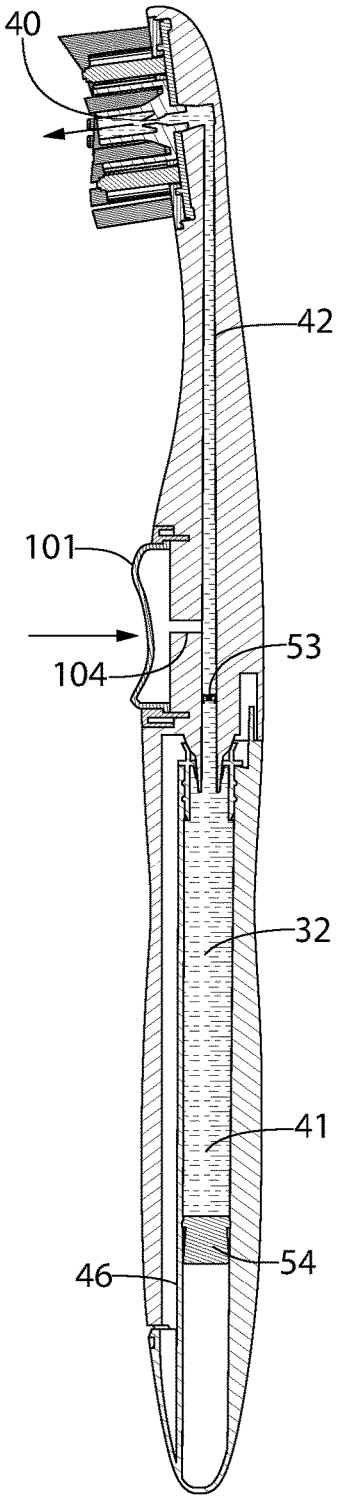
FIG. 17C is a third longitudinal cross-sectional view showing the pumping mechanism in a pumping or dispensing operating position.
Figure 18A:
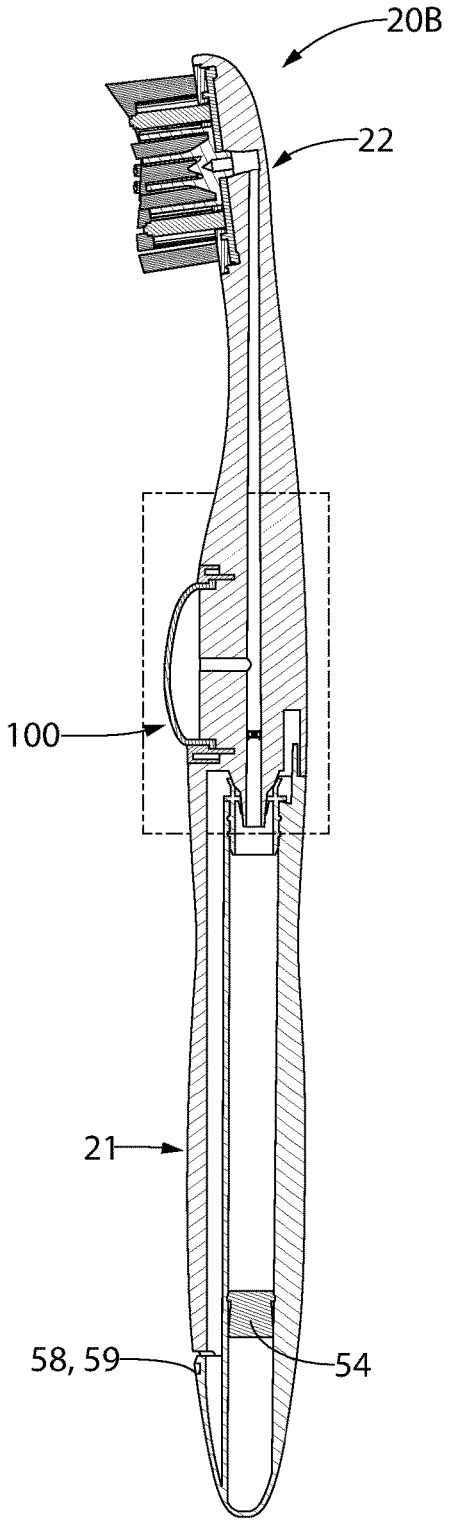
FIG. 18A is a longitudinal cross sectional view of the toothbrush showing a first spacer insert installed in pumping mechanism of the toothbrush.
Figure 18B:
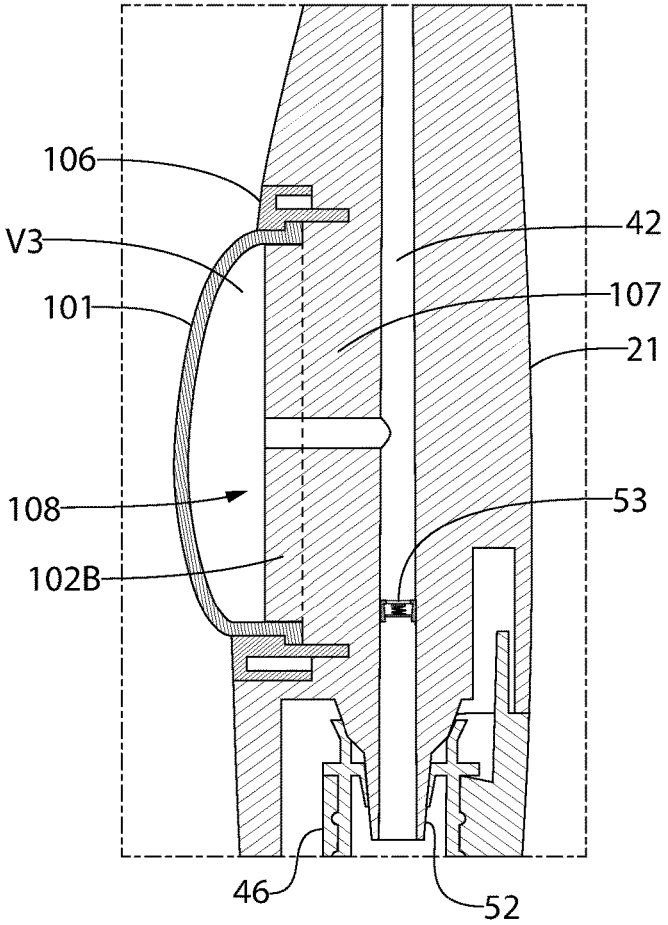
FIG. 18B is an enlarged view taken from FIG. 18A.
Figure 19A:
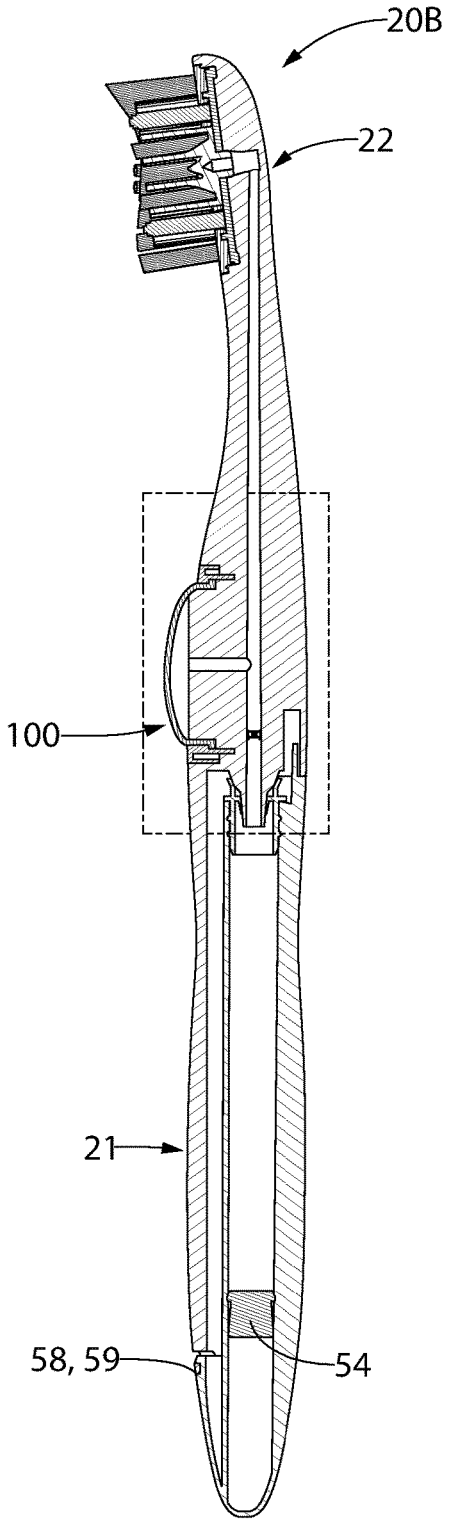
FIG. 19A is a longitudinal cross sectional view of the toothbrush showing a second spacer insert installed in pumping mechanism of the toothbrush.
Figure 19B:
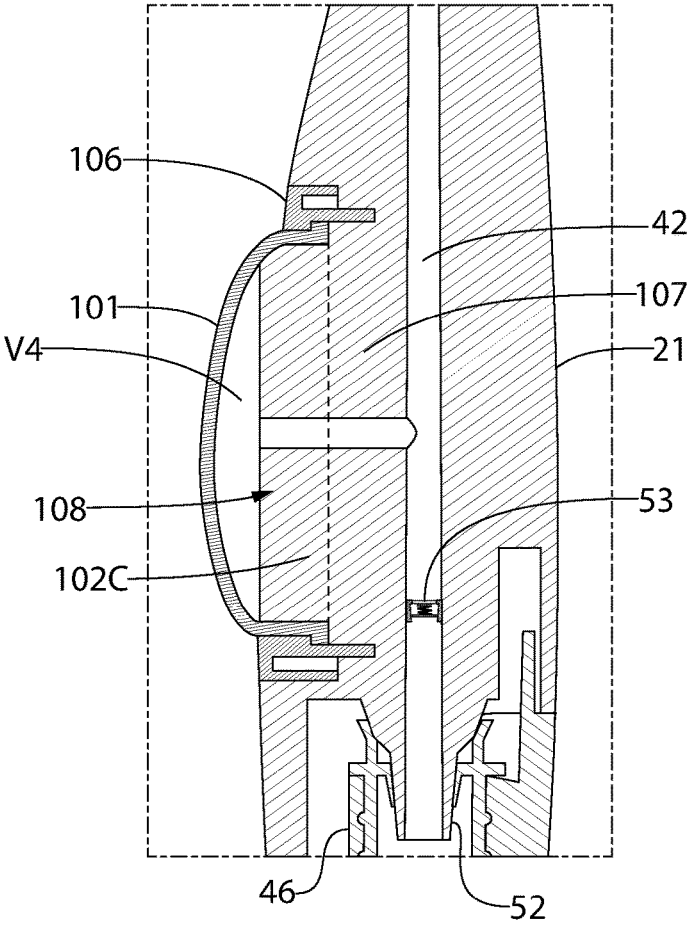
FIG. 19B is an enlarged view taken from FIG. 19A.
Figure 20A:
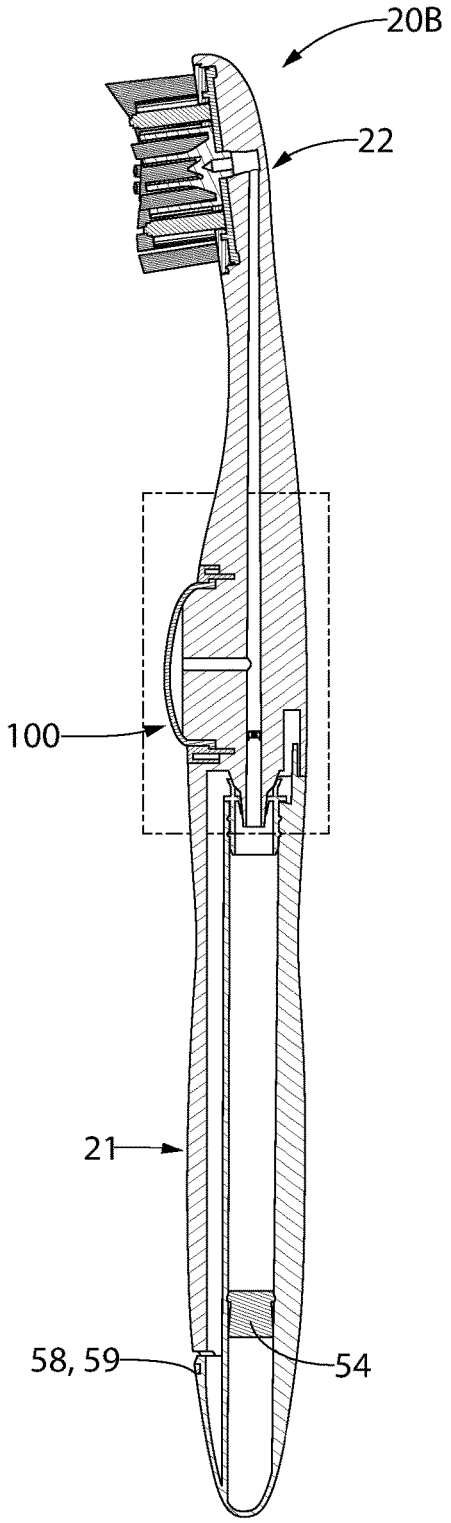
FIG. 20A is a longitudinal cross sectional view of the toothbrush showing a third spacer insert installed in pumping mechanism of the toothbrush.
Figure 20B:
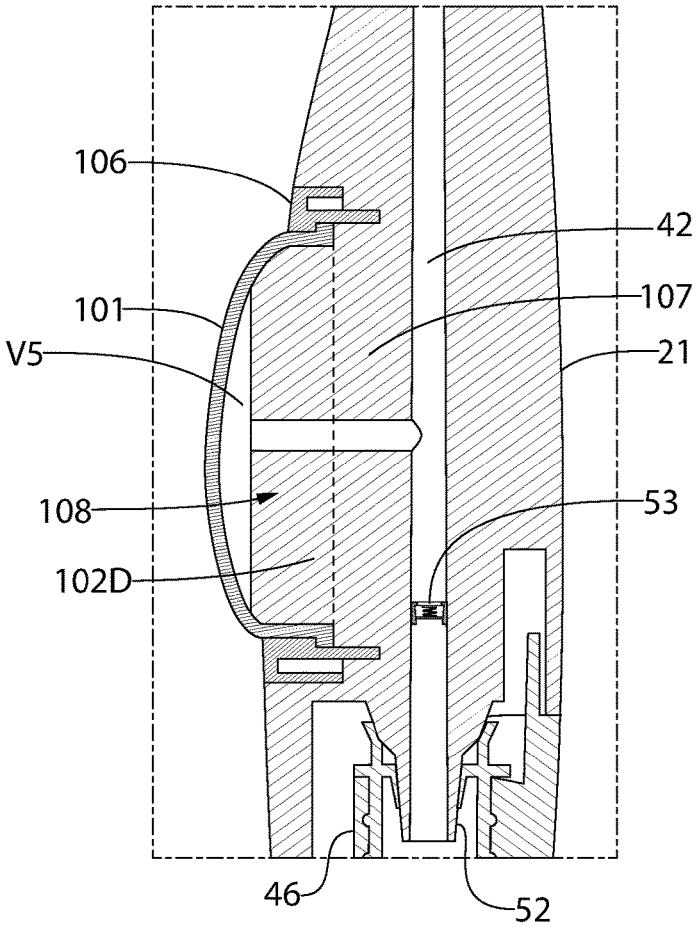
FIG. 20B is an enlarged view taken from FIG. 20A.

Referring to FIGS. 17A-C, the fluid pump mechanism generally functions as follows to dispense oral care fluid through the duckbill valve 40 to the tooth cleaning element array on toothbrush head 22. First, the user initially depresses/compresses and releases the button 101 the first time the toothbrush is used (FIG. 17A—see directional arrows). On the release of the button, a vacuum is created as the button resiliently returns to its original undeformed shape which pulls the oral care fluid from the reservoir 41 into the internal flow conduit 42 extending from the reservoir through the handle 21, neck 23, and head 22 (FIG. 17B). During the next press of the button 101 (FIG. 17C), the compression of air trapped below the button 101 propels the oral care fluid through the toothbrush length and out of the discharge slit 45 of the duckbill valve 40 on the toothbrush head. The vacuum force generated on the button's return stroke the second time (not shown but similar to FIG. 17B) refills the amount of fluid in the flow conduit 42 that was just dispensed. The refilled flow conduit is now ready to again dispense oral care fluid upon the next press of the actuator button 101, and so on.

The amount or volume of liquid dispensed after an actuator button push, also referred as the dosage, is directly proportional to the volume of air that is trapped beneath the depressible elastomeric button 101 which is compressed under the force of the button push or stroke by the user and displaced. There may be times when the desired fluid output volume needs to be modified, perhaps for example due to active ingredient regulatory limits, desired dosage of different active ingredients delivered with each stroke of the button 101, dispensing fluid viscosity changes, cost savings, and/or other reasons. However, for a given toothbrush, the monolithic body of the toothbrush where the actuator button 101 is mounted is dimensionally fixed by the metal molds used to injection mold the monolithic polymeric toothbrush body. This in turn dimensionally fixes the amount or dosage of oral care fluid which can be delivered with each depression of the actuator button. To change the dosage via reconfiguring (i.e. shape and/or dimensions) of the button seating area of the toothbrush handle beneath the button, an entirely new set of injection molds must be designed and procured which is an expensive proposition.

The present disclosure provides a modular fluid dispensing mechanism which eliminates the need for new injection molds each time adjustments need to be made to the dosage delivery by the fluid dispensing system. The same base toothbrush body substrate may be reused. The modular fluid dispensing mechanism thus comprises the same base toothbrush body and plurality of selectable spacer inserts 102 of different configurations (i.e. shape and/or height) implemented under the button. The different spacer inserts modify and change the volume of air trapped beneath the button and hence the volume of oral care fluid delivery with each depression or stroke of the compressible actuator button 101. Accordingly, the spacer insert can limit the button travel, and therefore the output volume of the dispensing system, depending on the height and shape of the spacer chosen. This means that potentially only one small dimensional change would need to be made in the handle body via the spacer inserts 102 to advantageously deliver a complete platform of products with reduced manufacturing complexity.

Figure 15:
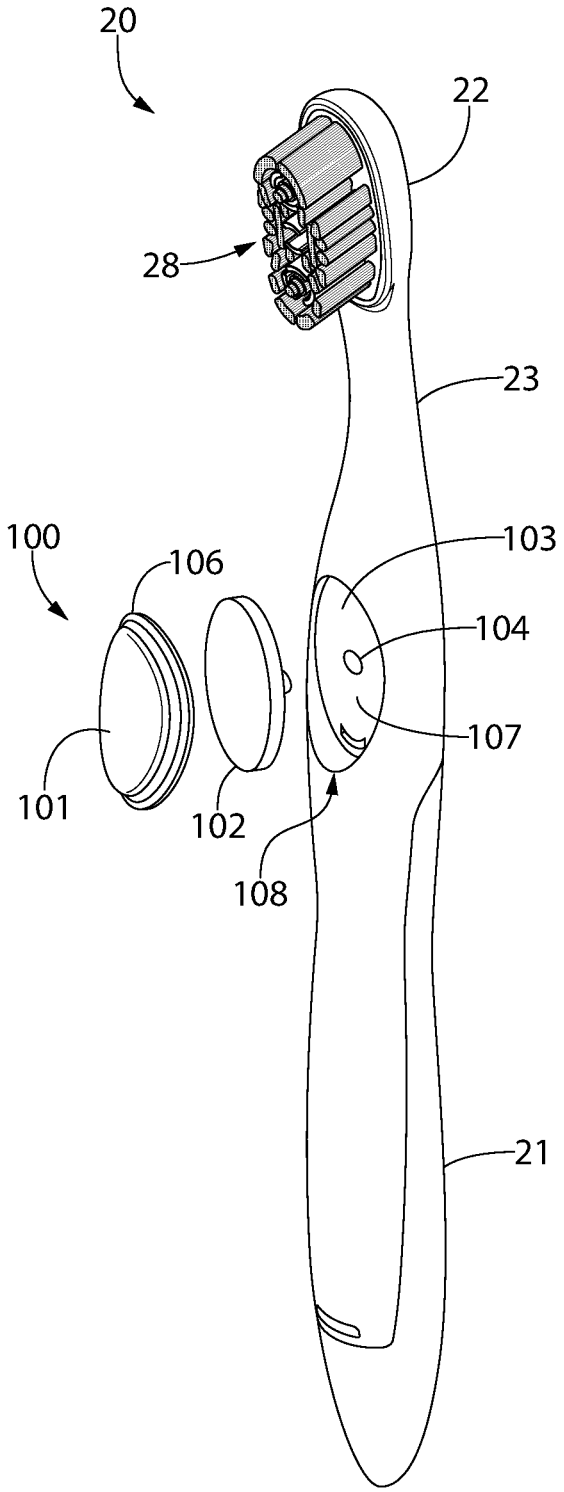
FIG. 15 is a front perspective view of the toothbrush with the pumping mechanism exploded out.

FIG. 15 is an exploded view showing the modified button assembly comprising elastomeric actuator button 101, button retaining ring 106, and one of a plurality of spacer inserts 102. The button seating area 108 of toothbrush handle 21 defines a front facing and outwardly open pump recess or cavity 103 which is fully enclosed by the button to form a trapped volume of air. The pump cavity 103 defines a fixed spacer insert mounting interface (i.e. shape and dimensions) configured to accept a plurality of different interchangeable spacer inserts 102 each having a commonly configured mounting interface (i.e. common mounting interface) adapted to fit in the cavity, as further described herein. Pump cavity 103 is complementary configured to the button 101 as best shown in FIG. 15. In one embodiment, both the pump cavity 103 and button 101 may have any oval shape; however, other non-polygonal shapes (e.g. circular) and polygonal shapes may broadly be used.

FIG. 16 shows the fluid dispensing mechanism of toothbrush 20 without use of the spacer insert 102 for the moment, which forms the baseline oral care fluid pumping volume or dosage. Referring to FIGS. 15 and 16, actuator button 101 is coupled to toothbrush handle 21 via the retaining ring 106. Retaining ring 106 is received in circumferentially-extending retention groove 109 which extends continuously around the perimeter of the pump cavity 103 of the handle. Button 101 includes an annular retaining flange 110 which protrudes outwardly from the base of the button. The flange is trapped in groove 109 by an annular stepped portion 111 of the retaining ring 106 via a press snap fit to secure the button to the toothbrush.

Actuator button 101 may have an outwardly protruding bulbous or domed shape in one embodiment forming a resilient elastomeric diaphragm structure which is manually depressible and displaceable with each fluid pumping stroke by the user. The button is supported and attached to toothbrush handle 21 in the button seating area 108 only along its perimeter. Other button shapes may be used in other embodiments.

Frontally open pump cavity 103 in handle 21 has a depth which extends partially through the handle in a direction transverse to longitudinal axis LA of toothbrush 20 and does not intersect the fluid transfer flow conduit 42. The pump cavity 103 is terminated at bottom by a partition base wall 107 of handle 21 which extends from the flow conduit 42 outwards to the cavity 103. Base wall 107 is formed as an integral unitary structural part of the molded monolithic toothbrush body and not separable therefrom. The thickness T1 of base wall 107 creates an associated fixed depth D1 measured between the underside of button 101 and outward facing surface of the base wall in pump cavity 103. When the actuator button 101 is mounted to the toothbrush handle 21, a trapped baseline or fixed volume V1 associated with depth D1 is collectively defined between the button and the outward facing front surface of the base wall 107 which may be planar in one embodiment as shown. Thought of another way, the volume created by underside concavity 135 of the actuator button 101 and the volume of pump cavity 103 collectively define the trapped fixed volume V1. Flow passage 104*a*, which may be a through hole, extends completely through the base wall 107 and intersects fluid transfer flow conduit 42 in the handle 21 of toothbrush. Flow passage 104*a* may intersect flow conduit 42 downstream of a check valve 53 arranged in the flow conduit. Check valve 53 prevents backflow into fluid reservoir 41 from flow conduit 42 by allowing only unidirectional flow outwards therefrom. Suitable commercially-available wafer type spring-to-close check valves for this application are available from Tecofi France and other suppliers. Other suitable types of unidirectional flow check valves may be used.

Flow passage 104*a* in base wall 107 of the toothbrush handle 21 places the trapped fixed volume V1 beneath button 101 in fluid communication with the flow conduit 42, which therefore in turn operably connects the actuator button 101 to the fluid reservoir 41 in cartridge 46 for extracting oral care fluid and duckbill valve 40 on the toothbrush head 22 and dispensing the oral care fluid via a pumping action or stroke of the button by the user. Volume V1 represents and directly corresponds to the actual volume or dosage of oral care fluid dispensed from reservoir 41 with each press (movement) of the actuator button 101 during a pumping stroke without the spacer insert 102 modifications disclosed herein being used. For some dosage applications and types/formulations of oral care agents contained in the oral care fluid, this may be the appropriate and desired volume to be dispensed by the fluid pumping mechanism.

For other oral care fluids and agents, however, the fixed volume V1 may not represent the desired and/or appropriate dosage. In such instances, the trapped volume of air between the actuator button 101 and base wall 107 however may be modified and customized via the interchangeably mountable spacer inserts 102. The spacer inserts 102 reduce the volume and concomitantly the delivered or dispensed dosage of oral care agent with each pumping stroke without altering the base toothbrush body or injection molds. The thickness of base wall 107 and corresponding depth of pump cavity 103 should therefore be initially selected preferably to provide the maximum anticipated dosage of oral care fluid which will be needed for a variety of different oral care agents and/or dosages contemplated since the volume/dosage cannot be increased beyond the fixed volume V1, but only reduced via the spacer inserts 102.

FIGS. 23A-23D show a plurality of different interchangeable spacer inserts 102 which may be selected and inserted into pump cavity 103 of handle 21 to reduce and change the volume or dosage of oral care fluid dispensed with each fluid pumping stroke initiated by the user from the baseline fixed volume V1. The inserts have different configurations and dimensions which effectively alter the volume of the pump cavity 103 by modifying the original configuration and thickness of the unitary base wall 107 provided with the monolithic toothbrush body. Considered another way, the spacer inserts 102 alter the depth of the pump cavity 103 which forms the trapped volume of air beneath the button 101 which is displaced with each push of the actuator button to deliver an associated dosage of oral care fluid.

Figure 23A:
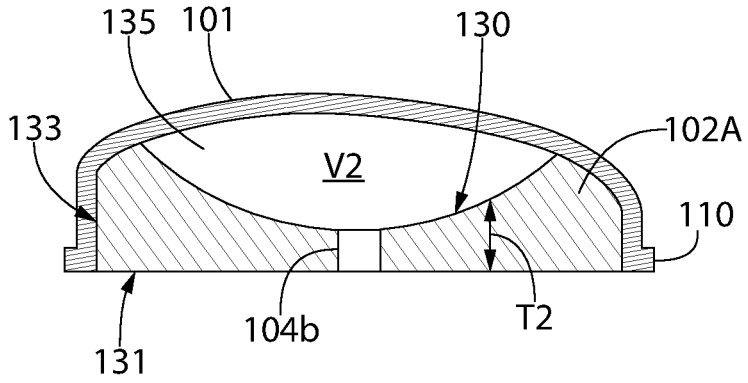
FIG. 23A is a view of the actuator button and spacer insert of FIG. 21B.
Figure 23B:
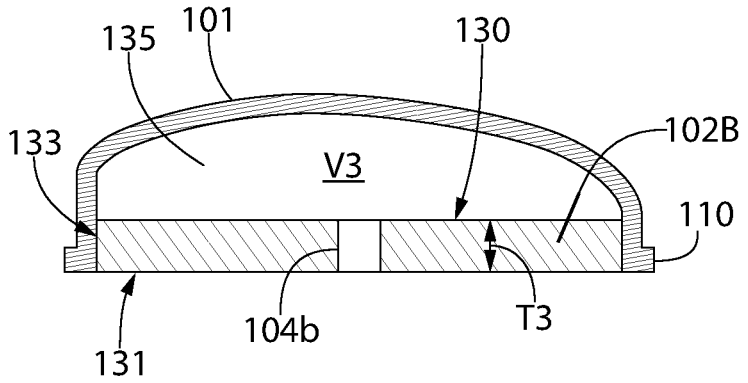
FIG. 23B is a view of the actuator button and spacer insert of FIG. 18B.
Figure 23C:
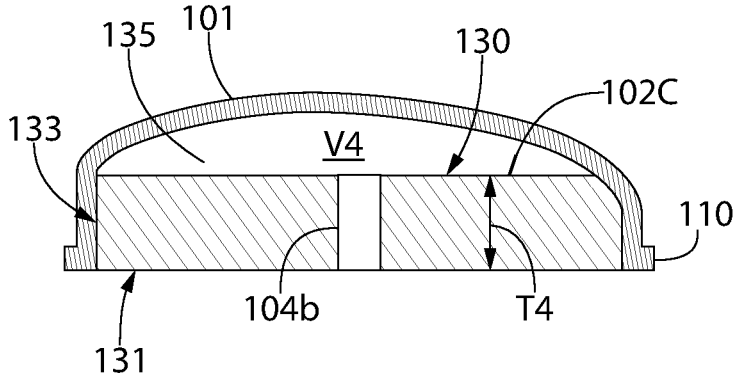
FIG. 23C is a view of the actuator button and spacer insert of FIG. 19B.
Figure 23D:
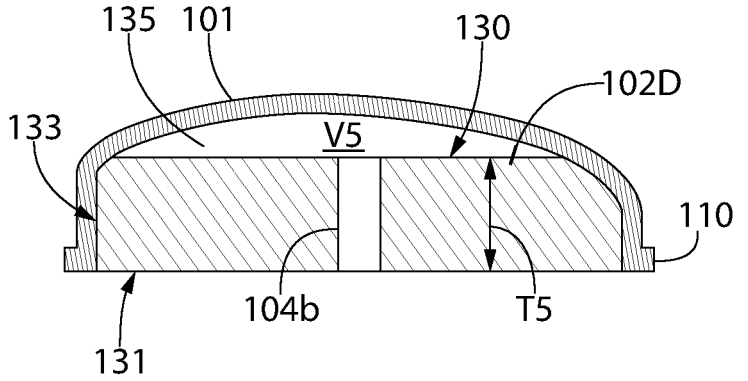
FIG. 23D is a view of the actuator button and spacer insert of FIG. 20B.

FIG. 23A shows a concave spacer insert 102A having an outward facing concavity which forms a trapped volume V2 beneath the actuator button 101. Insert 102A has a variable thickness T2 which is largest at the periphery of the insert and smallest in the central region as shown. It bears noting that an alternative opposite spacer insert concept may be a convex spacer with an outwardly protruding convexity in lieu of a concavity. FIG. 23B shows a first flat spacer insert 102B with planar outward surface having a thickness T3 associated with forming a trapped volume V3. FIG. 23C shows a second flat spacer insert 102C with planar outward surface having a thickness T4 associated with forming a trapped volume V4 which is less than V3. FIG. 23D show a third flat spacer insert 102A with planar outward surface having a thickness T5 associated with forming a trapped volume V5 which is less than V3 and V4. Volumes V2-V5 are all less than the original baseline or fixed volume V1 without the spacer insert modification added to the toothbrush base wall 107.

Each spacer insert 102A-D comprises a flow passage 104*b* which is concentrically aligned with flow passage 104*a* extending through base wall 107 when the insert is mounted to the toothbrush. With the insert in place, this collectively forms a continuous flow passage between the trapped volumes V2, V3, V4, or V5 and fluid dispensing system flow conduit 42.

The common mounting interface shared by each spacer insert which is compatible for mounting with the fixed mounting interface defined by the complementary configured handle pump cavity 103 includes the same shaped perimeter sidewalls 132 dimensioned to fit within the inward facing concavity 135 on the underside of actuator button 101, and same shaped inner surface 131 for forming a flat-to-flat abutting engagement with the base wall 107 of the handle 21 (see, e.g., FIGS. 16, 18A-21B, and 23A-D). The spacer inserts 102 are therefore at least partially received within the concavity of the button 101. The thicknesses T2-T5 and shape of the outer surface 130 of each spacer insert 102A-D facing the button 101 may be different as they do not affect the common mounting interface and interchangeability of the inserts.

In one method or process, insert molding may be used to directly integrate the spacer inserts 102 into the body 20*a* of toothbrush 20; the later which will include base wall 107. A variety of spacer inserts 102A-D may be prefabricated and molded separately from the toothbrush body. The inserts may be formed of the same or different polymeric material used for molding the toothbrush body. A method or process for forming a toothbrush with a preset or preselected oral care fluid dosage using spacer inserts may be summarized as follows. First, the processes starts by selecting a spacer insert 102 from a plurality of prefabricated spacer inserts 102A-D each having different configuration.

It bears noting that the term "configuration" as used here and throughout this disclosure shall be construed to include both shape and dimension (i.e. thickness, depth, width, height, length, diameter, etc.).

The next step in the process or method is inserting the selected spacer insert into an injection mold in the button seating area of the toothbrush handle portion of the injection mold. Next, the process or method continues with molding the toothbrush body onto the selected spacer insert 102, thereby directly integrating the insert into the toothbrush body formation. The advantage of this insert molding process is that the spacer insert is directly and permanently incorporated into the toothbrush body substrate when originally molded thereby providing a seamless integration of insert and body into a single inseparable component.

After the injection molding operation is completed, the button 101 may be attached to toothbrush 20 by first positioning the button over the spacer insert 102 and into retention groove 109, and then inserting the retaining ring 106 into the groove over the annular retaining flange 110 of the insert via a press fit. The fluid pumping mechanism of the toothbrush is now complete and ready for operation.

In a related alternative process, the spacer inserts may instead be directly overmolded on the toothbrush body structure which is first injection molded separately. The toothbrush body substrates are then placed in a separate mold where the overmolding will take place. The spacer inserts are then injection molded onto the substrates to complete integration of the inserts and toothbrush body.

FIGS. 18A-21B depicts each of the spacer inserts 102A-D in a fully assembled condition in the toothbrush 20 after either of the two forgoing injection molding process approaches and subsequent attachment of the actuator button 101.

Figure 22A:
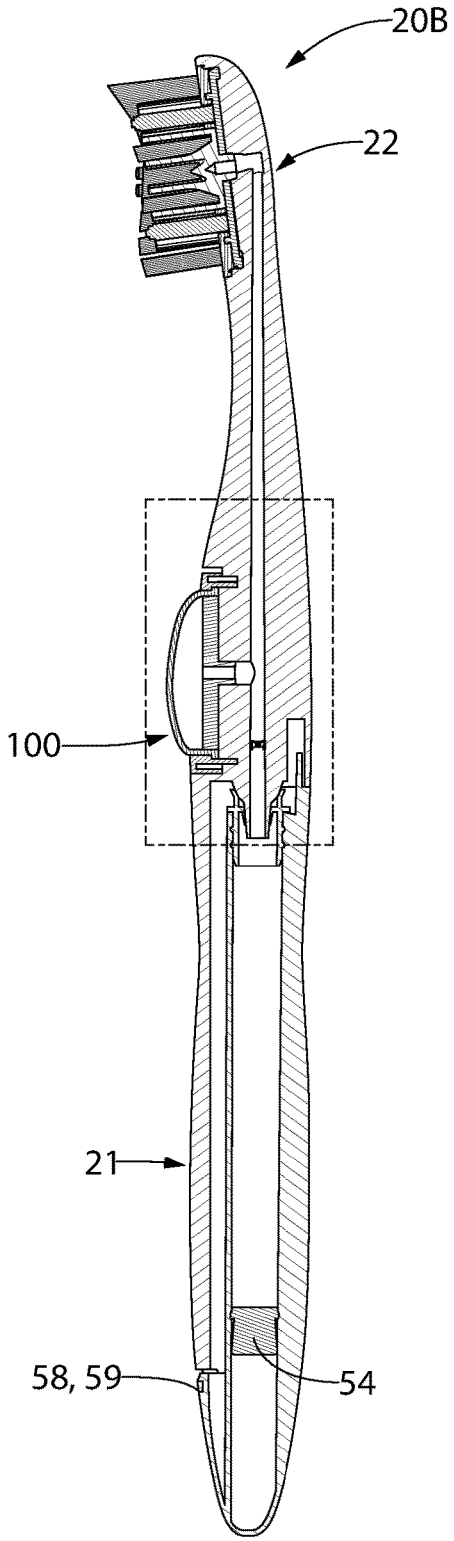
FIG. 22A is a longitudinal cross sectional view of the toothbrush showing a fifth spacer insert installed in pumping mechanism of the toothbrush.
Figure 22B:
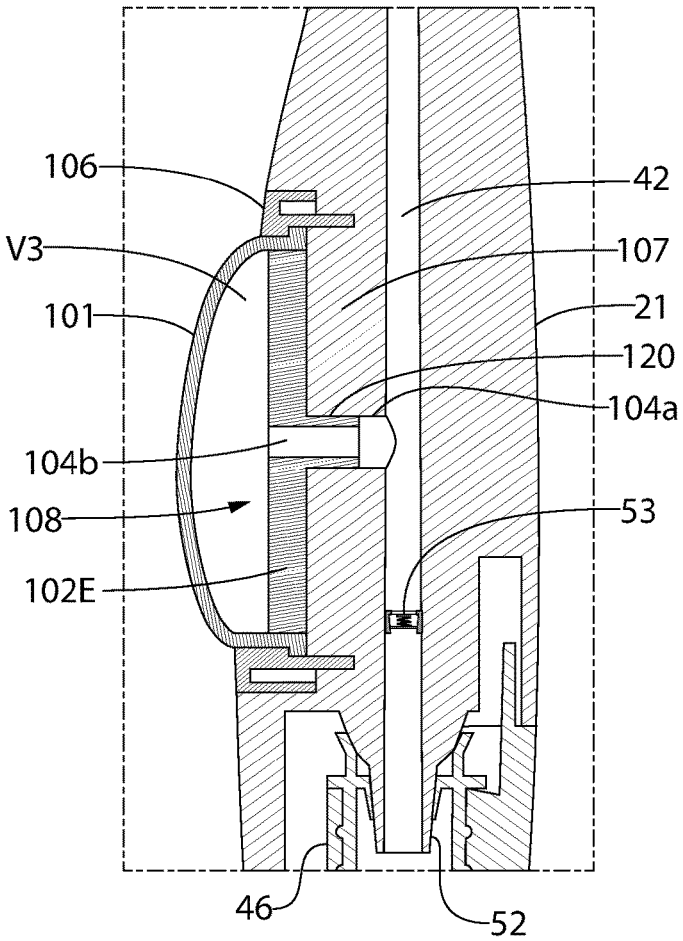
FIG. 22B is an enlarged view taken from FIG. 22A.

In lieu of integrating the spacer inserts 102 via molding, FIGS. 22A-B show an alternative approach of mechanically attaching the inserts to the toothbrush. In this embodiment, spacer insert 102E is provided with a protruding stem 120 which includes flow passage 104*b*. The stem is sized to be inserted into corresponding flow passage 104*a* formed in base wall 107 of the toothbrush body 20*a* (as shown) after the toothbrush body substrate has been molded. A frictional press fit is provided between insert stem 120 and flow passage 104*a* to retain the insert in place. The actuator button 101 is then installed via the retaining ring 106 as previously described herein. Any of the foregoing configurations of insert stems 102A-D, or others, may be used for the mechanically attached spacer insert 102E. A trapped air volume V3 is shown to illustrate that the same trapped volume as created by the insert molded spacer insert 102B shown in FIGS. 18B and 23B may be created via use of the mechanically mounted insert 102E.

Non-limiting examples of active agents which can be incorporated into the oral care fluid F include antibacterial agents, whitening agents, anti-sensitivity agents, anti-inflammatory agents, anti-attachment agents, plaque indicator agents, flavorants, sensates, and colorants. Examples of these agents include metal ion agents (e.g., stannous ion agents, copper ion agents, zinc ion agents, silver ion agents) triclosan; triclosan monophosphate, chlorhexidine, alexidine, hexetidine, sanguinarine, benzalkonium chloride, salicylanilide, domiphen bromide, cetylpyridinium chloride, tetradecylpyridinium chloride, N-tetradecyl-4-ethylpyridinium chloride (TDEPC), octenidine, delmopinol, octapinol, nisin, essential oils, furanones, bacteriocins, flavans, flavinoids, folic acids, vitamins, hydrogen peroxide, urea peroxide, sodium percarbonate, PVP-$H_2O_2$, polymer-bound peroxides, potassium nitrates, occluding agents, bioactive glass, arginine salts, arginine bicarbonate, bacalin, polyphenols, ethyl pyruvate, guanidinoethyl disulfide, tartar control agents, anti-stain ingredients, phosphate salts, polyvinylphosphonic acid, PVM/MA copolymers; enzymes, glucose oxidase, papain, ficin, ethyl lauroyl arginate, menthol, carvone, and anethole, various flavoring aldehydes, esters, and alcohols, spearmint oils, peppermint oil, wintergreen oil, sassafras oil, clove oil, sage oil, eucalyptus oil, marjoram oil, cinnamon oil, lemon oil, lime oil, grapefruit oil, and/or orange oil.

The active agent and/or its medium can be selected to complement a toothpaste formula, such as by coordinating flavors, colors, aesthetics, or active ingredients. A flavor can be administered to create a gradual flavor change during brushing, which presently is not possible using toothpaste alone.

The active agent may be compatible with toothpaste, or may be unstable and/or reactive with typical toothpaste ingredients. The active agent also may be a tooth cleaning agent to boost the overall efficacy of brushing.

The active agent can be provided in any suitable fluidic vehicle, such as in aqueous solution in some embodiments. Non-limiting examples of vehicles include water, monohydric alcohols such as ethanol, poly(ethylene oxides) such as polyethylene glycols such as PEG 2M, 5M, 7M, 14M, 23M, 45M, and 90M available from Union Carbide, carboxymethylene polymers such as Carbopol® 934 and 974 available from B.F. Goodrich, and combinations thereof. The selection of a suitable vehicle will be apparent to persons skilled in the art depending on such factors as the properties of the active agent and the desired properties of the medium, such as viscosity. Examples of tooth whitening compositions are described in U.S. Pat. Nos. 6,770,266 and 6,669,930, the disclosures of which are hereby incorporated by reference.

Although the fluid dispensing mechanism has been described and illustrated with respect to an oral care implement in the form of a toothbrush 20 in one embodiment for convenience of description, it will be appreciated that the fluid dispensing mechanism may be embodied in other types of oral care implements such as whitening pens or similar implements that dispense other oral care active agents. Such alternative implements may be stand alone devices or removably docked in a toothbrush for use in conjunction with the tooth brushing regimen. Accordingly, the term "oral care implement" is to be broadly construed.

It will be understood that while the invention has been described in conjunction with specific embodiments thereof, the foregoing description and examples are intended to illustrate, but not limit the scope of the invention. Other aspects, advantages and modifications will be apparent to those skilled in the art to which the invention pertains, and these aspects and modifications are within the scope of the invention and described and claimed herein.

What is claimed is:

1. A toothbrush with oral care fluid dispenser comprising:

an elongated body defining a longitudinal axis, a head defining a distal end, a handle defining a proximal end, and a neck extending between the head and handle;

the head comprising an array of tooth cleaning elements;

a reservoir configured for storing an oral care fluid;

an actuator operable to dispense the oral care fluid from the reservoir;

an elastomeric valve nested between a spaced apart pair of a first protective lamella and second protective lamella, the valve fluidly coupled to the reservoir;

wherein the valve is resiliently changeable between a normally closed position and an open position for dispensing the oral care fluid from the reservoir when the actuator is actuated; and wherein during a brushing stroke in a first longitudinal direction, the first protective lamella folds to engage the second protective lamella and covers the valve to deter ingress of external fluids into the valve, and during a brushing stroke in an opposite second longitudinal direction, the second protective lamella folds to engage the first protective lamella and covers the valve to deter ingress of external fluids into the valve.

2. The toothbrush according to claim 1, wherein the pair of protective lamellas are disposed immediately adjacent to the valve such that there are no other tooth cleaning elements disposed between the valve and the protective lamella.

3. The toothbrush according to claim 1, further comprising laterally open flow areas formed between the pair of protective lamellas on each lateral side of the valve, the open flow areas forming a pathway which allows the oral care fluid to migrate laterally outwards from the valve to lateral tooth cleaning elements on the head adjacent to the valve.

4. The toothbrush according to claim 3, wherein the open flow areas are each confronted by a linear bristle tuft wall, the bristle tuft walls being disposed adjacent to and on opposite lateral sides of the valve.

5. The toothbrush according to claim 4, wherein the tuft walls have a height at least the equal to the pair of protective lamellas.

6. The toothbrush according to claim 1, wherein the first protective lamella is disposed on a proximal side of the valve and the second protective lamella is disposed on a distal side of the valve.

7. The toothbrush according to claim 1, wherein each protective lamella has a height equal to or greater than twice a height of the valve measured perpendicularly outwards from a planar front surface of the head.

8. The toothbrush according to claim 1, wherein the first and second protective lamella each have an arcuate transverse cross-sectional shape defining a concave recess facing the valve.

9. The toothbrush according to claim 1, wherein the valve is a duckbill valve positioned at a geometric center of the head.

10. The toothbrush according to claim 1, wherein the pair of protective lamella and valve are mounted to an anchor-free tuft head plate disposed on the head of the toothbrush.

11. The toothbrush according to claim 10, wherein the valve is a separate discrete component from the protective lamellas which is separately attached to the head plate.

12. The toothbrush according to claim 1, wherein the pair of protective lamella and valve are integrally molded as a single monolithic unitary part coupled to the head of the toothbrush.

13. The toothbrush according to claim 12, wherein the monolithic unitary part further includes a distal end cluster of lamella and a proximal end cluster of lamella formed as an integral part with the protective lamella and valve.

14. The toothbrush according to claim 1, wherein each of the protective lamellas further comprise an integrally molded angled stiffening rib formed on sides of the protective lamella facing away from the valve.

15. The toothbrush according to claim 14, wherein the stiffening rib on the first protective lamella is arranged on a distal side to resist bending of the first protective lamella towards the distal end of the body, and the second protective lamella is arranged on a proximal side to resist bending of the second protective lamella towards the proximal end of the body.

16. The toothbrush according to claim 1, wherein the valve is fluidly coupled to the reservoir by an internal flow conduit extending through the body of the toothbrush, the actuator being operably coupled to the flow conduit between the valve and the reservoir which is disposed in the handle.

17. The toothbrush according to claim 1, wherein the actuator comprises a resiliently deformable button which is manually depressible to pump oral care fluid from the reservoir through the valve.

* * * * *